US008136956B2

(12) United States Patent
Oketani et al.

(10) Patent No.: US 8,136,956 B2
(45) Date of Patent: Mar. 20, 2012

(54) LOW TEMPERATURE SHOWCASE WITH ILLUMINATIVE LAMP

(75) Inventors: Tetsuya Oketani, Ota (JP); Shigeo Matsuzawa, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 255 days.

(21) Appl. No.: 11/704,914

(22) Filed: Feb. 12, 2007

(65) Prior Publication Data

US 2007/0195517 A1 Aug. 23, 2007

(30) Foreign Application Priority Data

Feb. 22, 2006 (JP) ..... 2006/045318

(51) Int. Cl.
*A47F 11/10* (2006.01)
*A47F 23/06* (2006.01)
*F25D 27/00* (2006.01)

(52) U.S. Cl. ..... 362/133; 362/125; 362/126

(58) Field of Classification Search ..... 362/133, 362/125, 126
See application file for complete search history.

(56) References Cited

U.S. PATENT DOCUMENTS

| | | | | |
|---|---|---|---|---|
| 4,280,169 | A * | 7/1981 | Allen | 362/217.08 |
| 4,782,430 | A * | 11/1988 | Robbins et al. | 362/147 |
| 5,690,415 | A * | 11/1997 | Krehl | 362/125 |
| 5,855,487 | A * | 1/1999 | Kunishi | 439/232 |
| 5,993,024 | A * | 11/1999 | Tseng | 362/657 |
| 6,641,419 | B1 * | 11/2003 | Richardson | 439/230 |
| 7,308,987 | B2 * | 12/2007 | Richardson et al. | 211/189 |
| 2004/0174701 | A1 * | 9/2004 | Fiene | 362/133 |

FOREIGN PATENT DOCUMENTS

| | | | |
|---|---|---|---|
| EP | 0 657 708 | A1 | 6/1995 |
| JP | 04-137304 | A * | 5/1992 |
| JP | 5-6786 | | 1/1993 |
| JP | 5-69892 | | 9/1993 |
| JP | 7-143928 | | 6/1995 |

OTHER PUBLICATIONS

Partial European Search Report dated Jun. 6, 2008.
European Search Report dated Aug. 27, 2008.
Japanese Office Action dated Jan. 18, 2011 (in Japanese).

* cited by examiner

*Primary Examiner* — William Carter
(74) *Attorney, Agent, or Firm* — Kratz, Quintos & Hanson, LLP

(57) ABSTRACT

An object is to provide a showcase in which terminals of an illuminative lamp can electrically be connected to power supply portions of sockets securely and safely and in which an attaching operation of the illuminative lamp can be simplified; the showcase is provided with the sockets each including a main body side socket member which connect the illuminative lamp to a power source of a main body and an illuminative lamp side socket member; the main body side socket member includes a connecting section in which a power supply contact piece is stored; the illuminative lamp side socket member includes an attachment section to be attached to an end portion of the illuminative lamp, and a storage section; the terminal is opposed to the inside of the storage section in a state in which the attachment section is attached to the end portion of the illuminative lamp; and the terminal is electrically connected to the power supply contact piece, and the power supply contact piece is urged toward the terminal by a pressing portion formed at the storage section in a state in which the connecting section is stored in the storage section.

9 Claims, 20 Drawing Sheets

LOW TEMPERATURE SHOWCASE WITH ILLUMINATIVE LAMP

BACKGROUND OF THE INVENTION

The present invention relates to an illuminative lamp disposed to illuminate the inside of a showroom or a front part of a showcase. The present invention more particularly relates to a showcase provided with an illuminative lamp having terminals at end portions.

Heretofore, in a showcase installed in a supermarket, a convenience store or the like, an illuminative lamp for illuminating the inside of a showroom, a front part of a showcase or the like is disposed in the showroom formed in a main body. The illuminative lamp is positioned and attached to a lower surface of a canopy positioned at a front part of a ceiling surface of the showroom, or a front part of a lower surface of a shelf in a case where a plurality of shelves are arranged. As the illuminative lamp, a fluorescent lamp or the like is generally used. Therefore, a replacement operation is required owing to deterioration with age.

Each illuminative lamp disposed in the showroom is connected to feeder lines connected to a power source disposed in a machine room (see, e.g., Japanese Patent Application Laid-Open No. 7-143928 (Document 1)). Since the illuminative lamp is attached to the front part of the showroom, the feeder lines are drawn and wired to an attachment position of the illuminative lamp, and fixed along the lower surface of the shelf or the ceiling surface. As shown in FIGS. 57 and 58, sockets 202 are attached to end portions of feeder lines 201. When terminals 204 disposed at end portions of an illuminative lamp 203 are attached to the sockets 202, the illuminative lamp 203 is electrically connected to the feeder lines 201, and electrically connected to a power source 205 via the feeder lines 201.

In this case, in consideration of an operability in attaching or detaching the illuminative lamp to or from the sockets connected to the feeder lines, the feeder lines in the vicinity of the sockets are fixed to the vicinity of an attachment place of the illuminative lamp in a state in which predetermined looseness is kept in the feeder lines. Therefore, in a state in which the illuminative lamp is attached, there has been a problem that, when the feeder lines sag downward from the lower surface of the shelf or the ceiling surface, the feeder lines are exposed on the front surface of the showroom, and an appearance is unfavorable.

Moreover, the illuminative lamp electrically connected to the feeder lines via the sockets is fixed by holding the lamp with clips or the like fixed to the lower surface of the shelf or the ceiling surface of the showroom. Especially, in a low-temperature showcase or the like which is internally cooled for use, to inhibit illuminance of an illuminative lamp such as the fluorescent lamp from being lowered owing to dependence on a temperature, a thermal insulation cylinder is mounted on the illuminative lamp. Therefore, since the long illuminative lamp attached to the showcase so as to range from side to side needs to be detached from or attached to a plurality of clips attached in a longitudinal direction, or detached from or attached to each socket during a replacement operation, there is a problem that the operation is troublesome.

To solve the problem, an attaching device of the fluorescent lamp is developed as disclosed in, for example, Japanese Utility Model Application Laid-Open No. 5-69892 (Document 2) in order to simplify the above-described replacement operation of the illuminative lamp and prevent exposure of the feeder lines. This attaching device of the fluorescent lamp is constituted of a socket main body fixed to a lower surface of a shelf, and fluorescent lamp holders fixedly attached to the socket main body. The fluorescent lamp holders are attached to opposite ends of the fluorescent lamp provided with terminal pins for receiving power. When the fluorescent lamp holders are attached to the socket main body, the feeder lines are not loosened or exposed from the shelf lower surface, and the fluorescent lamp is attached to the shelf lower surface by only engagement of the fluorescent lamp holders with the socket main body.

However, in the above-described socket constitution disclosed in Document 2, the terminal pins for receiving the power come into contact with power supply contact pieces by use of elastic forces of the pieces themselves. In consequence, the pins are electrically connected to the pieces. Therefore, when the power receiving terminal pins are repeatedly inserted and disengaged, the elastic forces of the power supply contact pieces weaken, and there is a problem that contact defects are generated between the power receiving terminal pins and the power supply contact pieces. Such contact defects cause a disadvantage that the fluorescent lamp is not securely lit. In some case, temperatures of the power receiving terminal pins abnormally rise, and the terminal pins and the sockets might be burnt out.

Furthermore, in a conventional socket structure, the fluorescent lamp holders constituting the sockets are disengageably engaged with the socket main bodies by engagement of elastic pieces for bonding, formed externally from end surfaces of the fluorescent lamp holders on opposite sides with engagement pieces formed at the socket main bodies. In addition, when the fluorescent lamp itself is extracted downwards, such engagement is released. The fluorescent lamp holders are disengaged from the socket main bodies by applying a downward force. Therefore, when an attaching operation is repeatedly performed, engagement forces of these holders and main bodies weaken. In addition, there is an influence of a weight of the fluorescent lamp. Therefore, the fluorescent lamp attached to the sockets might fall together with the fluorescent lamp holders.

To solve the problem, such an engagement mechanism is constituted so that formed engagement members are fitted into each other in order to secure the mechanism. To disengage the members, the inwardly positioned engagement member is pressed inwards to release the engagement. However, in such a constitution, a large force for releasing the engagement has to be transmitted to the inwardly positioned engagement member, and there has been a problem of a troublesome operation.

Moreover, in the fluorescent lamp to be attached to the shelf lower surface, the ceiling surface of the showroom or the like, as shown in FIGS. 57 and 58, a capacitor 206 is electrically connected to the power source 205 disposed at a showcase main body via the connected feeder lines 201. In the sockets of the fluorescent lamp constituted as described above, the power receiving terminal pins of the fluorescent lamp can electrically be connected to the power supply contact pieces. However, the capacitor 206 is attached to a certain place of the showcase, and separately connected to the feeder lines connected to the power supply contact pieces. Therefore, wiring lines become complicated, and an operation of putting together the wiring lines has been troublesome.

On the other hand, to inhibit a disadvantage that heat of the fluorescent lamp leaks into the showroom, the fluorescent lamp holders of the conventional technology described above perform functions of support members to which a fluorescent lamp cover for thermal insulation is to be attached in order to inhibit a disadvantage that the illuminance of the fluorescent lamp drops in accordance with the temperature in the showroom. However, the support members of the fluorescent lamp cover formed at the fluorescent lamp holders are constituted by inserting cylindrical walls of the fluorescent lamp holders into the fluorescent lamp cover, the fluorescent lamp cover easily falls from the fluorescent lamp holders, and there has been a problem of a troublesome replacement operation of the illuminative lamp.

Furthermore, in a case where the showcase provided with the illuminative lamp is used as the low-temperature showcase, condensation is collected on the fluorescent lamp cover which surrounds the illuminative lamp itself and a periphery of the illuminative lamp, the condensation enters an electrically connected portion of the illuminative lamp, and short-circuit or the like might occur.

SUMMARY OF THE INVENTION

Therefore, the present invention has been developed to solve a conventional technical problem, and an object thereof is to provide a showcase in which terminals of an illuminative lamp can electrically be connected to power supply portions disposed at sockets securely and safely and in which an attaching operation of the illuminative lamp can be simplified.

A first invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the main body side socket member including: the internal power supply portion and a connecting section provided with an inserting portion capable of passing the terminal of the illuminative lamp, the illuminative lamp side socket member including: an attachment section which is to be attached to the end portion of the illuminative lamp; and a storage section formed externally from the attachment section and configured to disengageably store the connecting section in a state in which the illuminative lamp side socket member is attached to the main body side socket member, the terminal being opposed to the inside of the storage section in a state in which the attachment section is attached to the end portion of the illuminative lamp, the terminal being configured to enter the inserting portion and electrically connected to the power supply portion in a state in which the connecting section is stored in the storage section, the storage section of the illuminative lamp side socket member being provided with a pressing portion to urge the power supply portion toward the terminal in a state in which the connecting section is stored in the storage section. The showcase of a second invention is characterized in that in the above invention, the attachment section of the illuminative lamp side socket member is constituted of a cover portion which surrounds the end portion of the illuminative lamp and a holding portion which is formed at the cover portion and which holds the illuminative lamp.

A third invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member and the illuminative lamp side socket member having engagement portions which are disengageably engaged with each other, each engagement portion having an outwardly extending operating portion, the operating portion being operated to thereby disengageably engage the engagement portion.

The showcase of a fourth invention is characterized in that in the above invention, the engagement portion of the main body side socket member has a terminal holding portion to hold the terminal of the illuminative lamp in a state in which the illuminative lamp side socket member is attached to the main body side socket member.

A fifth invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member and the illuminative lamp side socket member having engagement portions which are disengageably engaged with each other, the engagement portion of the illuminative lamp side socket member being pressed inwards to disengage from the engagement portion of the main body side socket member, the main body side socket member being provided with an inclined surface which is formed externally from the end portion and which comes away from the engagement portion while inclined so as to form an acute angle with the engagement portion, the main body side socket member further including: a finger insertion space constituted between the inclined surface and the engagement portion.

A sixth invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member having a capacitor storage section in which a capacitor is stored.

A seventh invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member having a fixing section to the main body, the fixing section being provided with an earth terminal fixing portion.

An eighth invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the showcase further comprising: a thermal insulation cylinder which surrounds a periphery of the illuminative lamp, the thermal insulation cylinder having an end portion held by a thermal insulation cylinder holding portion formed on an outer peripheral surface of an attachment section of the illuminative lamp side socket member.

A ninth invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the illuminative lamp side socket member having an attachment section provided with a drain hole.

A tenth invention is directed to a showcase provided with an illuminative lamp having terminals at end portions, the showcase comprising: sockets which connect the illuminative lamp to a power source of a main body, each socket including: a main body side socket member fixed to the main body and having an internal power supply portion; and an illuminative lamp side socket member mounted on the illuminative lamp and detachably attached to the main body side socket member, the terminal of the illuminative lamp being electrically connected to the power supply portion of the main body side socket member directly or via a conductive member in a state in which the illuminative lamp side socket member mounted on the illuminative lamp is attached to the main body side socket member, the showcase further comprising: a waterproof mechanism to isolate the power supply portion and the terminal of the illuminative lamp from the outside in a watertight manner in a state in which the illuminative lamp side socket member is attached to the main body side socket member.

According to the first invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The main body side socket member includes the internal power supply portion; and the connecting section provided with the inserting portion capable of passing the terminal of the illuminative lamp. The illuminative lamp side socket member includes: the attachment section which is to be attached to the end portion of the illuminative lamp; and the storage section formed externally from the attachment section and configured to disengageably store the connecting section in the state in which the illuminative lamp side socket member is attached to the main body side socket member. The terminal is opposed to the inside of the storage section in the state in which the attachment section is attached to the end portion of the illuminative lamp. The terminal is configured to enter the inserting portion and electrically connected to the power supply portion in the state in which the connecting section is stored in the storage section. Moreover, the storage section of the illuminative lamp side socket member is provided with the pressing portion to urge the power supply portion toward the terminal in the state in which the connecting section is stored in the storage section. Therefore, when the illuminative lamp side socket member is attached to the terminal of the illuminative lamp and the illuminative lamp side socket member is attached to the main body side socket member, the pressing portion formed at the illuminative lamp side socket member can urge the power supply portion of the connecting section formed at the main body side socket member toward the terminal of the illuminative lamp. The power supply portions of the sockets can securely electrically be connected to the terminals of the illuminative lamp, and reliability can be improved.

In consequence, even in a case where a force is applied in a direction in which the terminals of the illuminative lamp attached to the main body via the sockets disengage from the power supply portions of the sockets owing to a weight of the illuminative lamp, the pressing portion of the illuminative lamp side socket member can securely press the power supply portion disposed at the main body side socket member onto the terminal of the illuminative lamp. It is possible to avoid in advance incomplete lighting due to a contact defect and burnout of the terminal and the socket due to an abnormal temperature rise.

According to the second invention, in the above invention, the attachment section of the illuminative lamp side socket member is constituted of the cover portion which surrounds the end portion of the illuminative lamp and the holding portion which is formed at the cover portion and which holds the illuminative lamp. Therefore, the end portion of the illuminative lamp attached to the illuminative lamp side socket member can be protected by the cover portion, and the illuminative lamp itself can stably be held by the illuminative lamp side socket member. A load can be inhibited from being applied to connection of the terminals of the illuminative lamp to the power supply portions disposed at the sockets.

In consequence, the terminals of the illuminative lamp can securely electrically be connected to the power supply portions.

According to the third invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. Moreover, the main body side socket member and the illuminative lamp side socket member have the engagement portions which are disengageably engaged with each other. Each engagement portion has the outwardly extending operating portion. The operating portion is operated to thereby disengageably engage the engagement portion. Therefore, the illuminative lamp side socket member can easily be detached from the main body side socket member. Especially, the operating portion extends outwards. Therefore, even when the sockets are attached to a lower surface of a shelf of the showcase or a ceiling surface, the operating portion can easily be recognized, and a replacement operation of the illuminative lamp can smoothly be performed.

According to the fourth invention, in the above invention, the engagement portion of the main body side socket member has the terminal holding portion to hold the terminal of the illuminative lamp in the state in which the illuminative lamp side socket member is attached to the main body side socket member. Therefore, the terminal of the illuminative lamp can be held by the terminal holding portion on the main body side socket member, the load can be inhibited from being applied to the connection of the terminal of the illuminative lamp to the power supply portion of the socket. Therefore, the terminals of the illuminative lamp can securely electrically be connected to the power supply portions.

According to the fifth invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. Moreover, the main body side socket member and the illuminative lamp side socket member have engagement portions which are disengageably engaged with each other. The engagement portion of the illuminative lamp side socket member is pressed inwards to disengage from the engagement portion of the main body side socket member. The main body side socket member is provided with the inclined surface which is formed externally from the end portion and which comes away from the engagement portion while inclined so as to form the acute angle with the engagement portion. The main body side socket member further includes: the finger insertion space constituted between the inclined surface and the engagement portion. When the engagement portion of the main body side socket member is engaged with the engagement portion of the illuminative lamp side socket member, the illuminative lamp side socket member can stably be attached to the main body side socket member.

Therefore, as compared with a conventional constitution in which the illuminative lamp is held by clips, the illuminative lamp can easily be attached to the main body, and an attaching operation can be simplified. When the illuminative lamp side socket member is stably engaged with the main body side socket member, the terminals of the illuminative lamp can stably be brought into contact with the power supply portion stored in the main body side socket member, and illumination can be performed stably and safely.

Moreover, when the engagement of the main body side socket member with the illuminative lamp side socket member is released, fingers inserted into the finger insertion space abut on the inclined surface. In consequence, a principle of a lever by use of an abutment point as an axis is applied. The engagement portion can be pressed inwards with a smaller force to release the engagement. Therefore, a trouble in an engagement operation of the main body side socket member with the illuminative lamp side socket member can be eliminated, and an attaching operation of the illuminative lamp can be simplified.

According to the sixth invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. Moreover, the main body side socket member has the capacitor storage section in which the capacitor is stored. Therefore, it is possible to store the capacitor in the socket, and a capacitor connected to the illuminative lamp via a feeder line does not have to be separately disposed in the showcase.

Therefore, a wiring line treatment of the feeder line can be simplified. The number of components can be reduced, and an assembling operation can be simplified.

According to the seventh invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. The main body side socket member has the fixing section to the main body. The fixing section is provided with the earth terminal fixing portion. Therefore, an earth terminal can safely be fixed to the main body side socket member. In consequence, a wiring line treatment of the earth terminal can be simplified.

According to the eighth invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. Moreover, the showcase further comprises: the thermal insulation cylinder which surrounds the periphery of the illuminative lamp. The thermal insulation cylinder has the end portion held by the thermal insulation cylinder holding portion formed on the outer peripheral surface of the attachment section of the illuminative lamp side socket member. Therefore, since the thermal insulation cylinder can securely be fixed to the illuminative lamp side socket member, it is possible to inhibit a disadvantage that the thermal insulation cylinder falls during a replacement operation of the illuminative lamp.

Especially, in the showcase is a low-temperature showcase, when the end portion of the thermal insulation cylinder is held by the illuminative lamp side socket member, cool air does not easily enter the thermal insulation cylinder in which the illuminative lamp is stored, and it is possible to inhibit a drop of illuminance from being caused by the illuminative lamp exposed to the cool air and having a temperature drop. Moreover, condensation collected on the surface of the thermal insulation cylinder is inhibited from entering the thermal insulation cylinder, the condensation does not easily enter the terminal or the like attached to the illuminative lamp side socket member, and the illuminative lamp can safely be used.

According to the ninth invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. The illuminative lamp side socket member has the attachment section provided with the drain hole. Therefore, especially in a case where the showcase is the low-temperature showcase, the condensation collected on the surface of the socket and entering the illuminative lamp side socket member can be discharged via the drain hole. It is possible to inhibit short-circuit due to the condensation, and the illuminative lamp can safely be used.

According to the tenth invention, the showcase provided with the illuminative lamp having the terminals at the end portions comprises: the sockets which connect the illuminative lamp to the power source of the main body. Each socket includes: the main body side socket member fixed to the main body and having the internal power supply portion; and the illuminative lamp side socket member mounted on the illuminative lamp and detachably attached to the main body side socket member. The terminal of the illuminative lamp is electrically connected to the power supply portion of the main body side socket member directly or via the conductive member in the state in which the illuminative lamp side socket member mounted on the illuminative lamp is attached to the main body side socket member. The showcase further comprises: the waterproof mechanism to isolate the power supply portion and the terminal of the illuminative lamp from the outside in the watertight manner in the state in which the illuminative lamp side socket member is attached to the main body side socket member. Therefore, especially in a case where the showcase is a low-temperature showcase, the waterproof mechanism isolates the terminals and the power supply portions from the outside. Therefore, it is possible to inhibit the short-circuit from being generated by the condensation collected on the surfaces of the sockets and entering the illuminative lamp side socket members. In consequence, even when the condensation is collected on the illuminative lamp and the sockets, the illuminative lamp can safely be used.

DETAILED DESCRIPTION OF THE PREFERRED EMBODIMENTS

An embodiment to which the present invention is applied will hereinafter be described in accordance with Embodiments 1 to 4.

Embodiment 1

Figure 1:
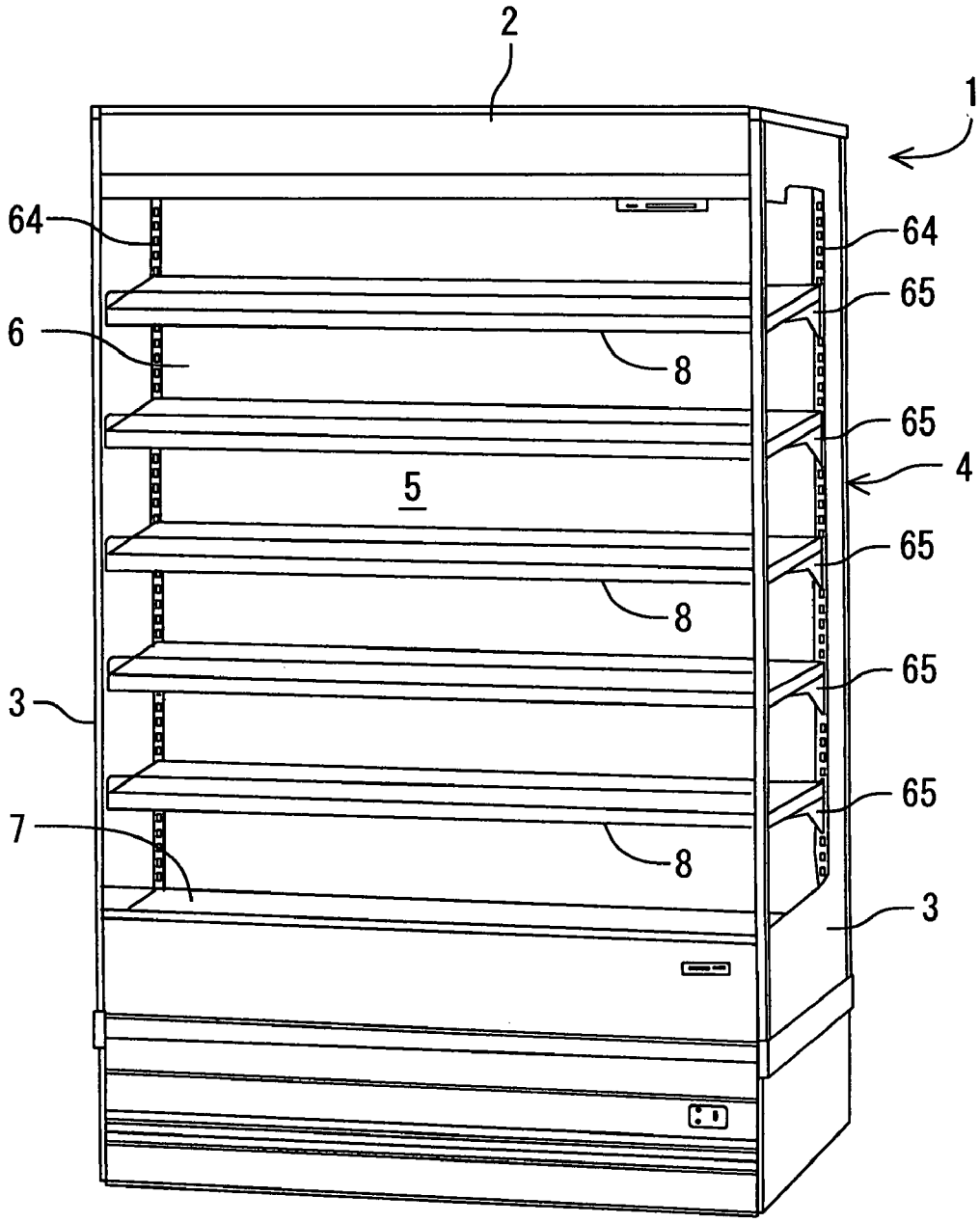
FIG. 1 is a perspective view of a low-temperature showcase.
Figure 2:
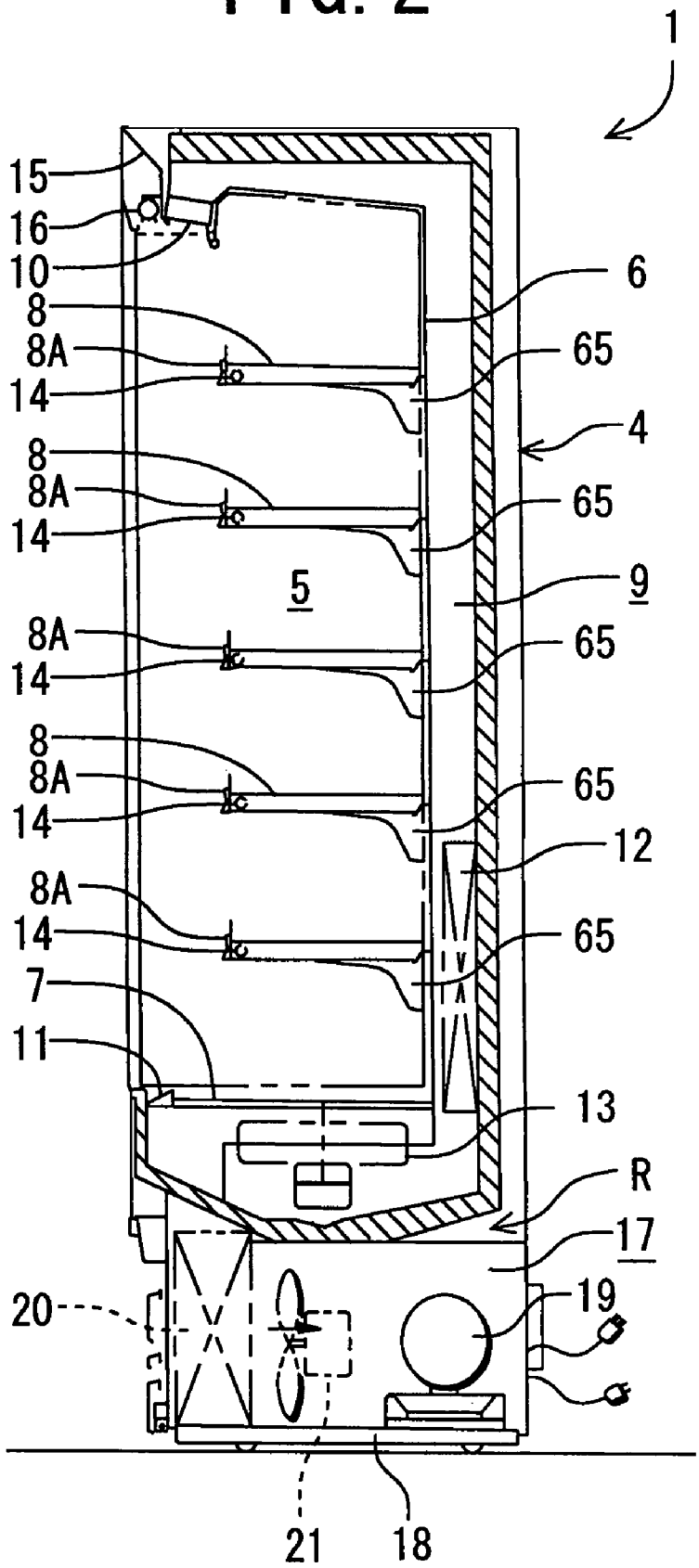
FIG. 2 is a schematic vertical side view of the low-temperature showcase of FIG. 1.
Figure 3:
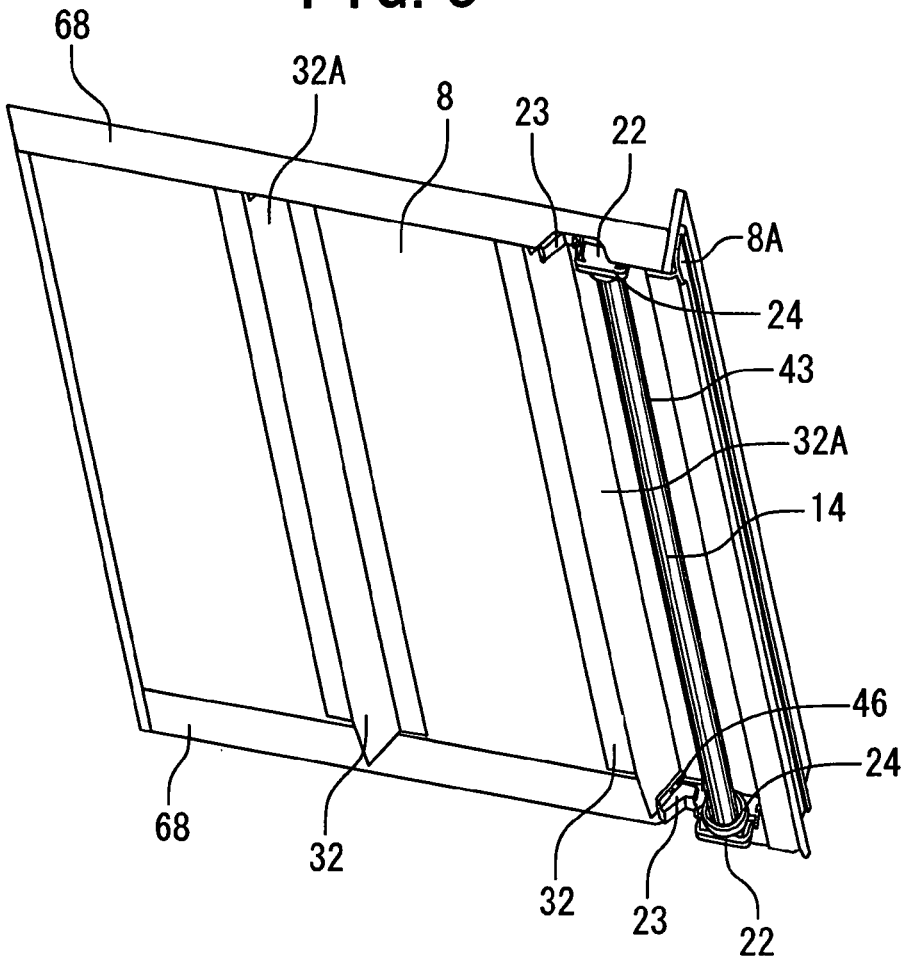
FIG. 3 is a perspective view of a lower surface of a shelf to which sockets and an illuminative lamp are attached (Embodiment 1)
Figure 4:
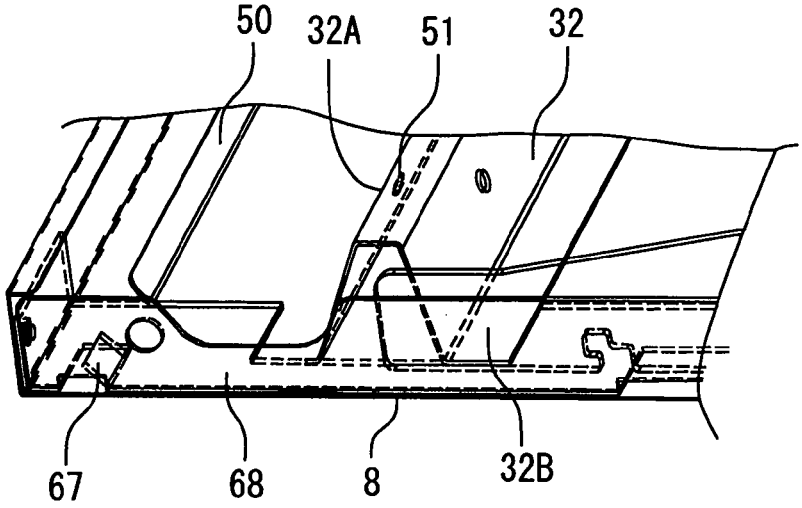
FIG. 4 is a partially perspective view of the shelf lower surface (Embodiment 1)

First, a showcase of Embodiment 1 will be described with reference to the drawings. FIG. 1 is a perspective view of a low-temperature showcase 1 as an embodiment of a showcase of the present invention, and FIG. 2 is a schematic vertical side view of the low-temperature showcase 1. FIG. 3 is a perspective view of a lower surface of a shelf 8, and FIG. 4 is a partially perspective view of the lower surface of the shelf 8. In the drawings, the low-temperature showcase 1 is installed in a store such as a supermarket or a convenience store. Side plates 3, 3 are attached to opposite sides of an insulation wall 2 substantially having a U-shaped section to constitute a main body 4. On an inner side of this insulation wall 2, a partition plate 6 and a bottom plate 7 are attached at an interval. On the inner side of these components, a showroom 5 having an opened front surface is constituted, and a series of ducts 9 are arranged between these components and the insulation wall 2.

Moreover, this duct 9 communicates with a discharge port 10 which opens at an opening upper edge of the showroom 5 and a suction port 11 which opens at an opening lower edge. Furthermore, a cooler 12 included in a cooling device R is vertically disposed in the duct 9 on a rear surface, and a blower 13 is disposed in the duct 9 under the bottom plate 7.

In the showroom 5, a plurality of shelves 8 . . . are arranged so as to extend vertically. The shelf 8 is held by supports 64 arranged in the showroom 5 via brackets 65, 65 attached to the left and the right. Reinforcement plates 32 are attached to a lower surface of this shelf 8 at predetermined intervals from left and right side ends so as to extend from side to side. In the present embodiment, two plates are disposed at a front part and a rear part of the lower surface of the shelf. As shown in FIG. 4, such a reinforcement plate 32 is substantially formed into a trapezoidal section having an upper side longer than a lower side. In the present embodiment, it is assumed that a lower surface of the plate is substantially the same plane as that of a lower end position of a price rail 8A attached to a front end of the shelf 8. A upper rear end of this reinforcement plate 32 is bent outwards to form a fixed surface, and fixed to the lower surface of the shelf 8 by spot welding.

Figure 25:
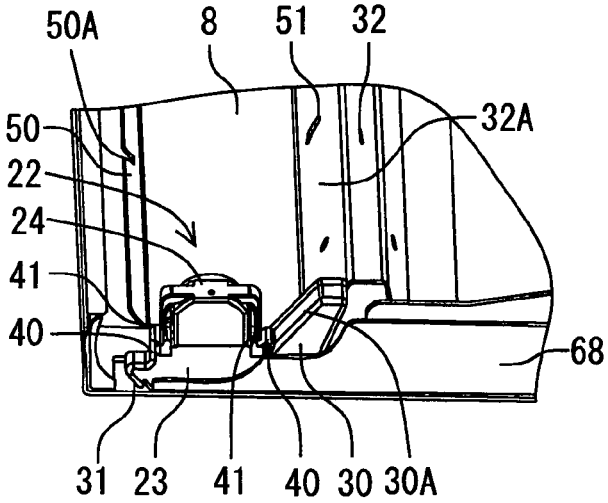
FIG. 25 is an enlarged perspective view showing that the socket is attached to an end portion of the shelf as viewed from below.

Furthermore, the lower surface of this shelf 8 is provided with a downwardly protruding attachment piece 50 positioned on a front side of the reinforcement plate 32 and extending from side to side. This attachment piece 50 is formed so as to be inclined forwards and downwards at a predetermined angle. Moreover, this piece is provided with a plurality of cutouts 50A at predetermined intervals as shown in FIG. 25. It is to be noted that in the present embodiment, the attachment pieces 50 are not formed at opposite side ends, and an end portion attachment piece 67 is formed by cutting and protruding downwards a part of a shelf plate constituting the shelf 8 at a similar angle in a position similar to that of the attachment piece 50.

Moreover, an illuminative lamp 14 is detachably attached to the lower surface of the shelf 8 via sockets 22 as described later in detail in order to illuminate commodities on the shelf 8 disposed under the lamp and a front part of the showroom 5.

In addition, a canopy 15 is positioned in front of the discharge port 10 and disposed at an upper edge of an opening in a front surface of the insulation wall 2. An illuminative lamp 16 is detachably attached to a lower portion of the canopy 15 via the socket 22 and the like described later in each embodiment in detail so as to illuminate the inside and periphery of the showroom 5 from above. It is to be noted that each of the illuminative lamps 14, 16 includes terminals for receiving power at end portions, can be lit by electricity supplied from a power supply portion, and is, for example, a fluorescent lamp, an LED or the like.

On the other hand, a machine room 17 is formed under the insulation wall 2, and a unit base 18 is disposed in the machine room 17. Moreover, a compressor 19, a condenser 20 and a blower 21 for the condenser included in the cooling device R are installed on the unit base 18, and arranged in the machine room 17.

According to the above constitution, when the blower 13 is operated, cool air subjected to heat exchange between air and the cooler 12 is raised in the duct 9, and discharged into the showroom 5 from the discharge port 10. Moreover, the cool air sucked from the suction port 11 is accelerated again by the blower 13, and the cool air is circulated through the showroom 5 to cool the showroom 5 at a predetermined temperature.

Figure 5:
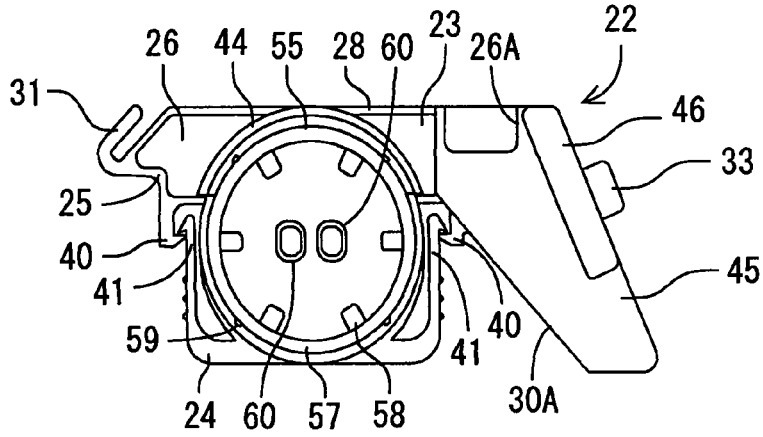
FIG. 5 is a side view of the socket attached to one side of a showroom (Embodiment 1)
Figure 6:
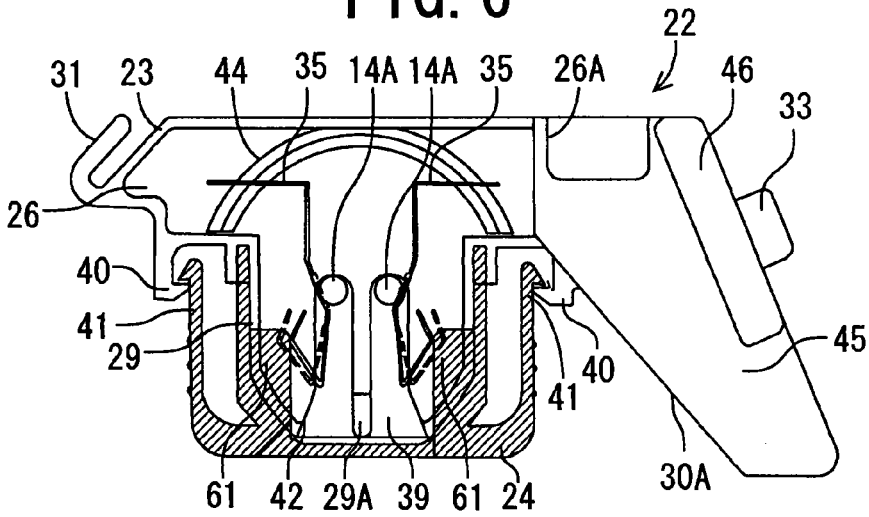
FIG. 6 is a partially see-through sectional view of the socket of FIG. 5 (Embodiment 1)
Figure 7:
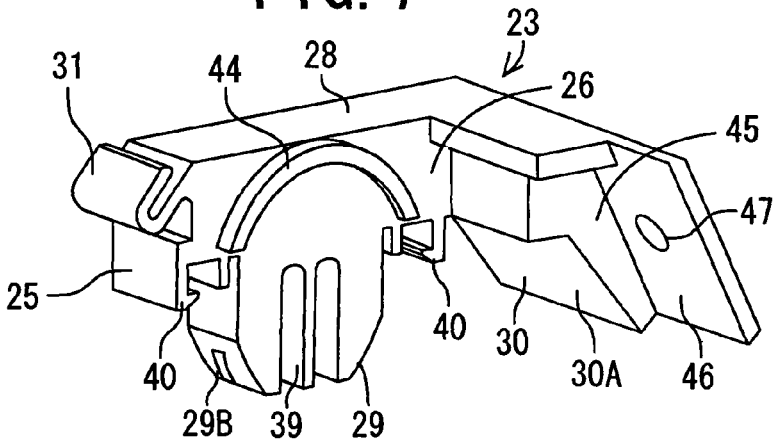
FIG. 7 is a perspective view of a main body side socket member (Embodiment 1)
Figure 8:
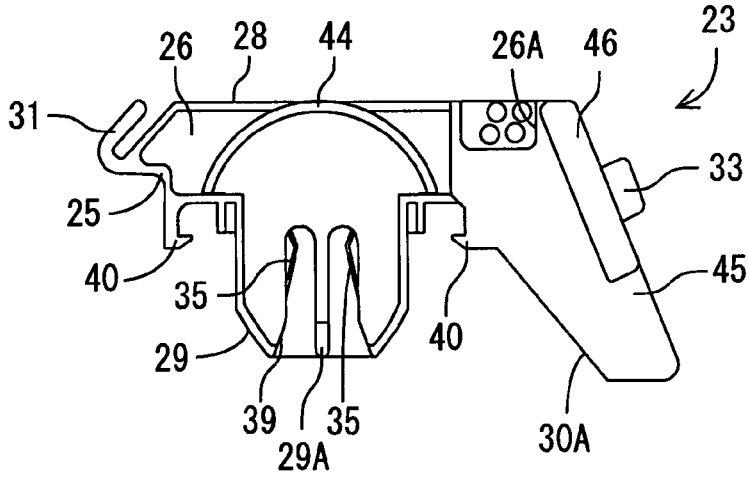
FIG. 8 is a side view of the main body side socket member (Embodiment 1)
Figure 9:
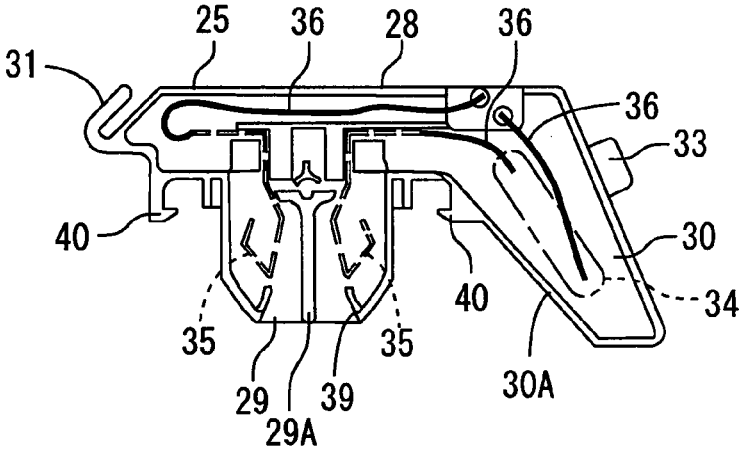
FIG. 9 is a side view of a housing of the main body side socket member (Embodiment 1)
Figure 10:
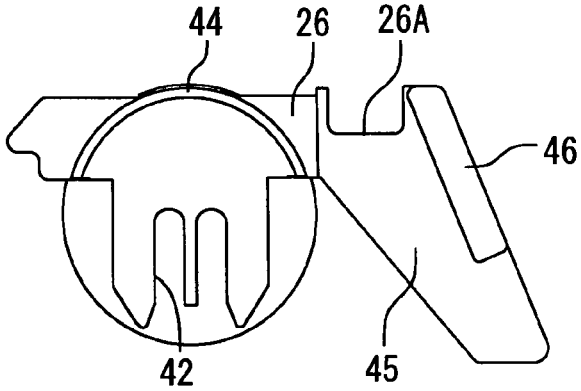
FIG. 10 is a side view of a lid member of the main body side socket member (Embodiment 1)
Figure 11:
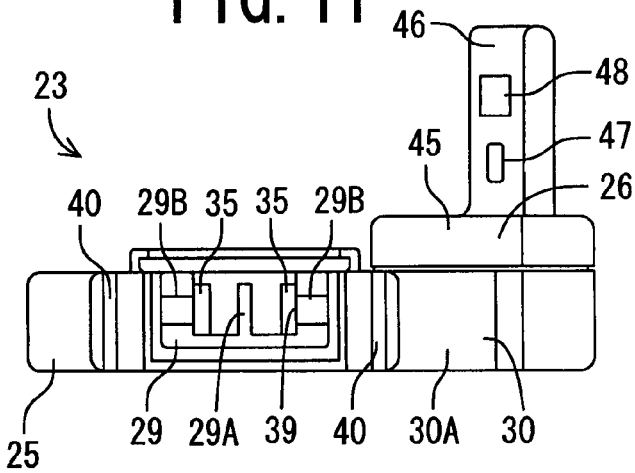
FIG. 11 is a plan view of FIG. 8 viewed from below (Embodiment 1)
Figure 12:
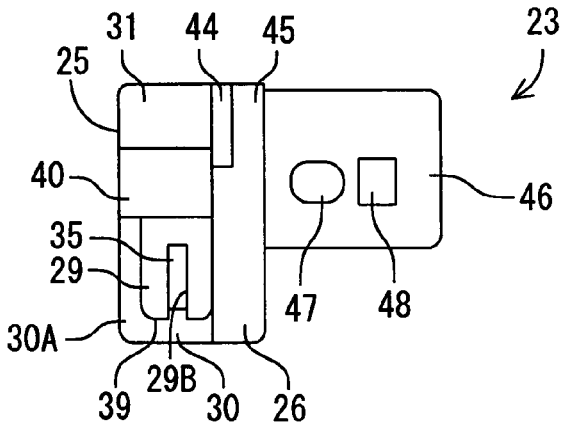
FIG. 12 is a front view of the main body side socket member (Embodiment 1)
Figure 13:
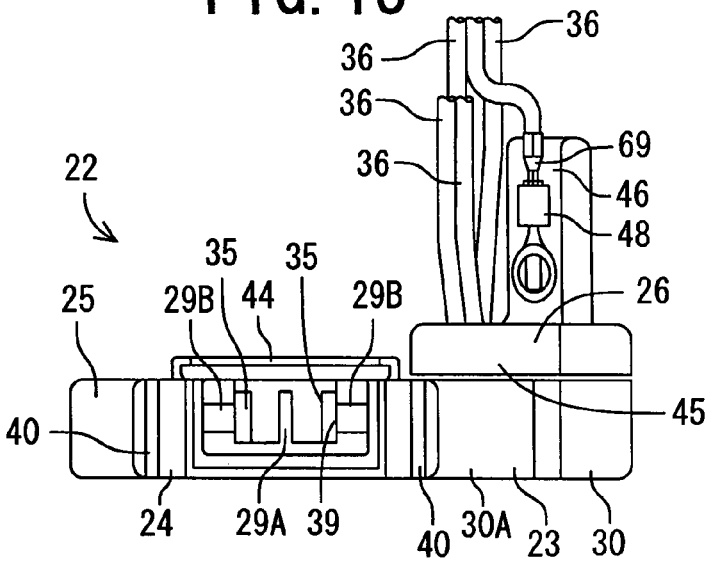
FIG. 13 is a diagram showing that a feeder line is attached to FIG. 11 (Embodiment 1)
Figure 14:
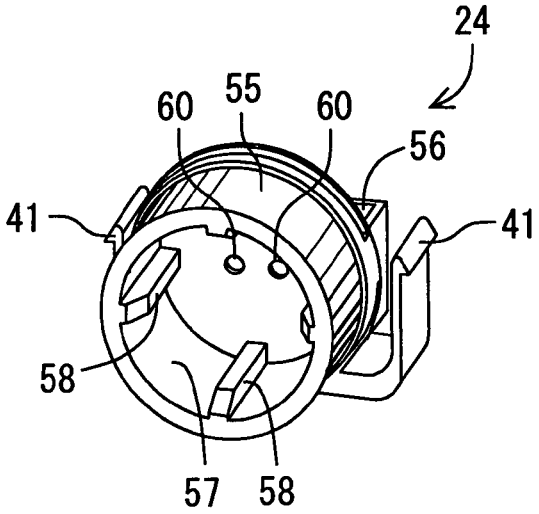
FIG. 14 is a perspective view of an illuminative lamp side socket member (Embodiment 1)
Figure 16:
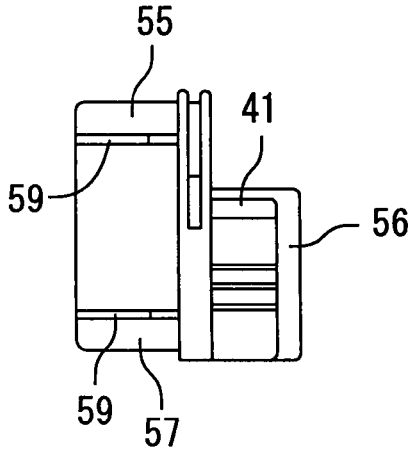
FIG. 16 is a diagram of FIG. 15 viewed from the right (Embodiment 1)
Figure 15:
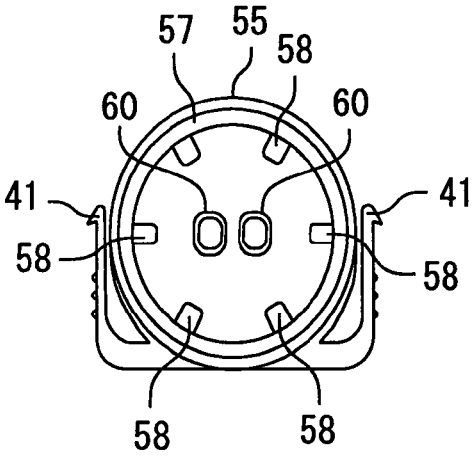
FIG. 15 is a side view of the illuminative lamp side socket member (Embodiment 1)
Figure 17:
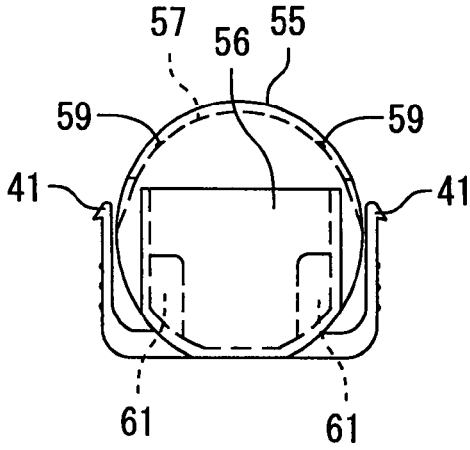
FIG. 17 is a diagram of FIG. 15 viewed from the backside (Embodiment 1)
Figure 18:
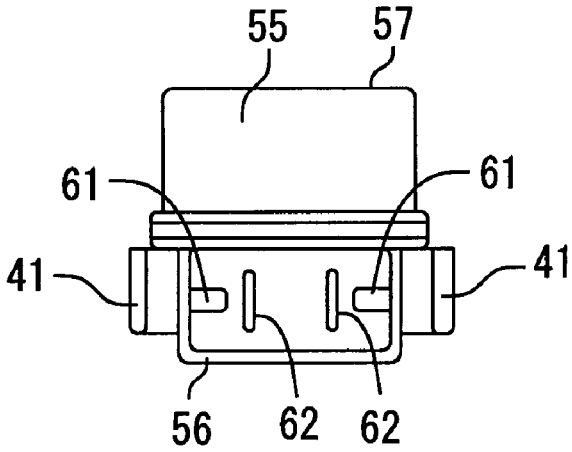
FIG. 18 is a diagram of FIG. 15 viewed from below (Embodiment 1)
Figure 19:
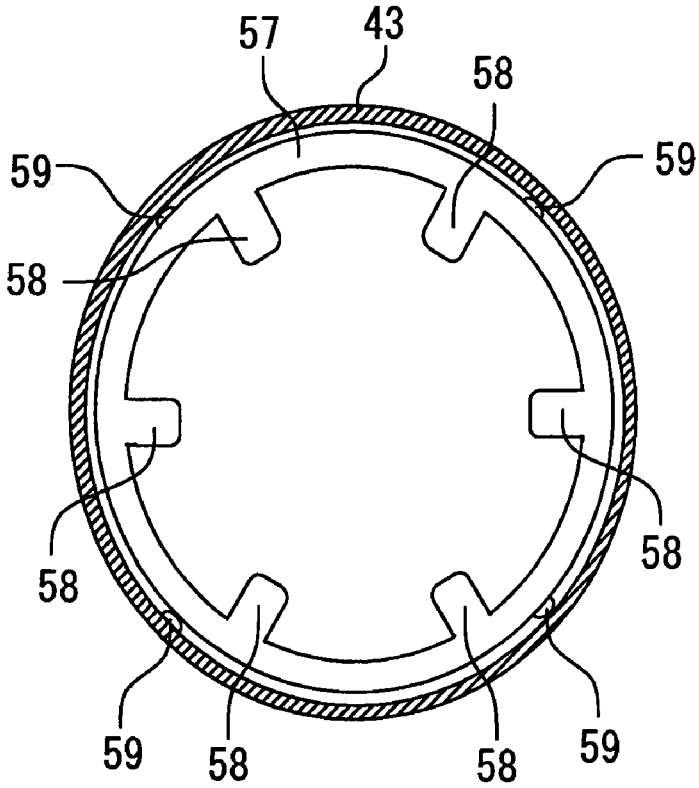
FIG. 19 is an enlarged sectional view of a cover portion (Embodiment 1)
Figure 20:
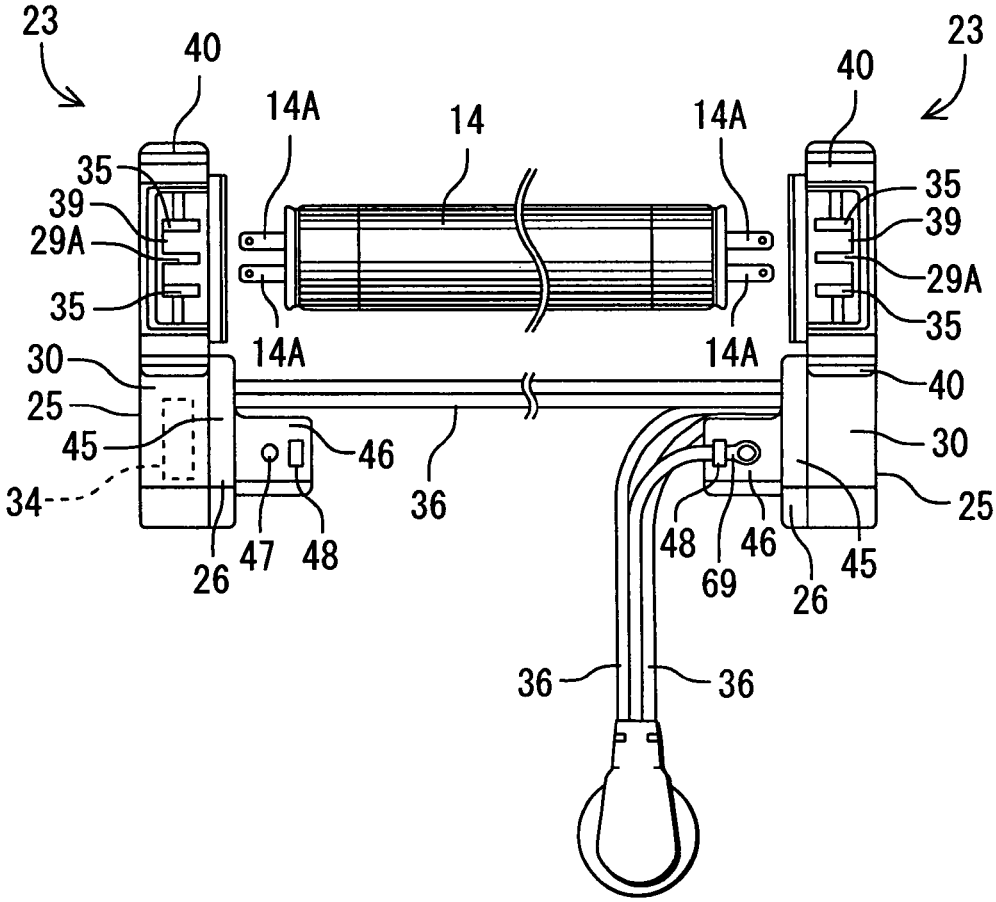
FIG. 20 is a schematic diagram showing that the feeder lines and the illuminative lamp are attached to the sockets (Embodiment 1)
Figure 21:
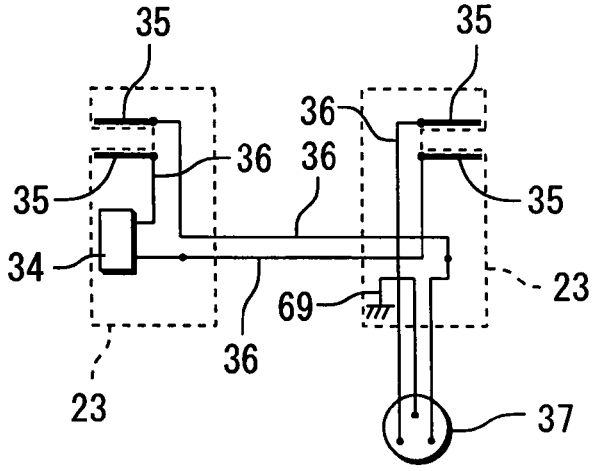
FIG. 21 is an electric wiring line diagram of FIG. 20 (Embodiment 1)
Figure 22:
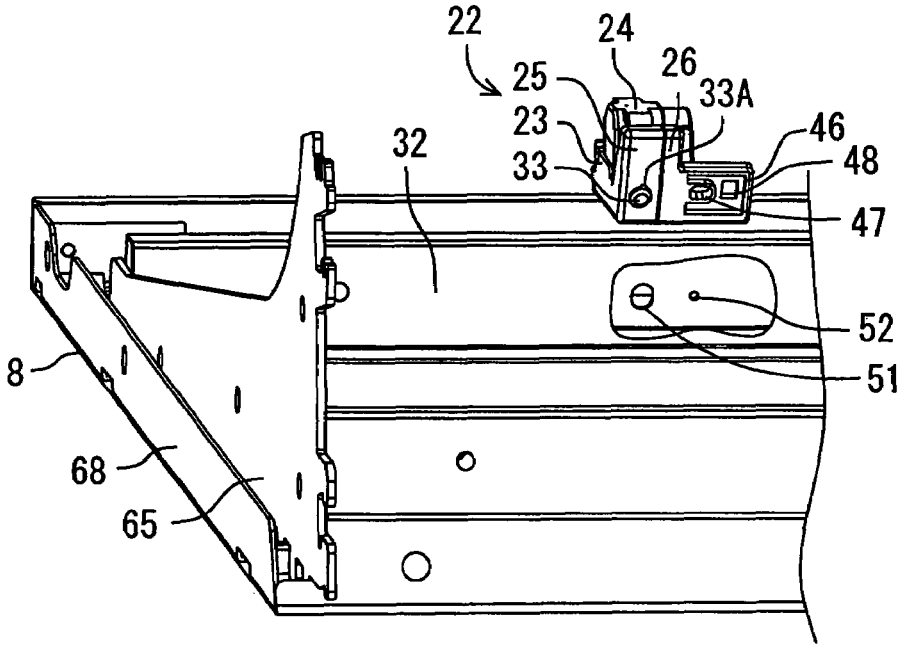
FIG. 22 is a partially cut perspective view showing that the socket is attached to the shelf lower surface as viewed from below (Embodiment 1)
Figure 23:
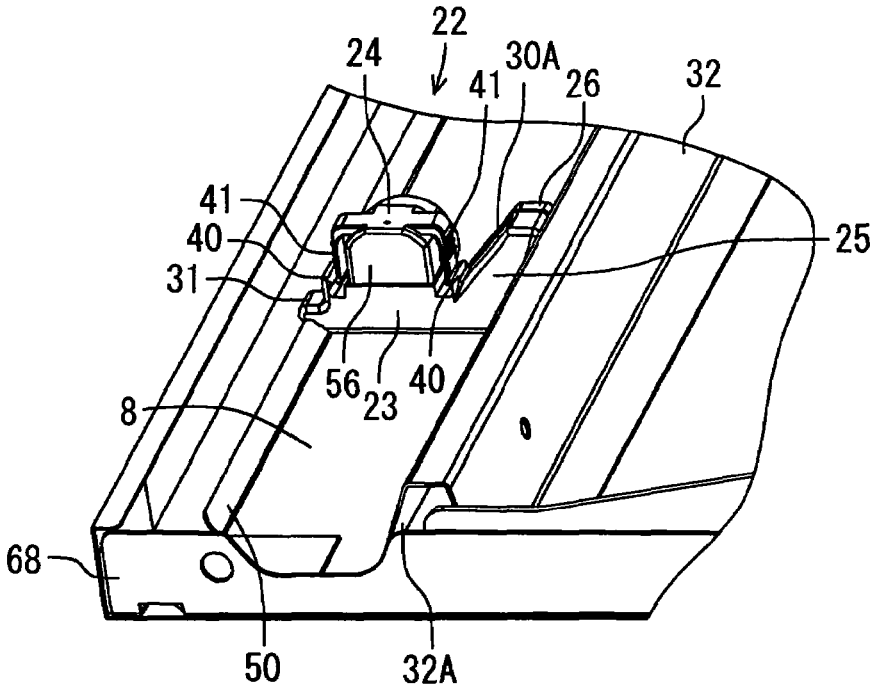
FIG. 23 is an enlarged perspective view showing that the socket is attached to the shelf lower surface as viewed from below (Embodiment 1)
Figure 24:
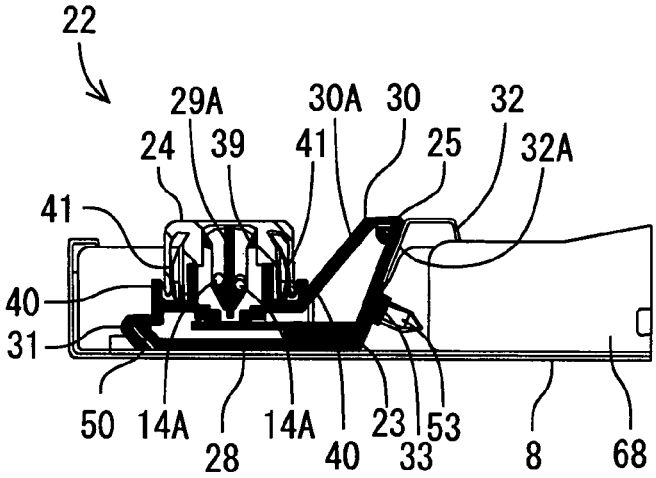
FIG. 24 is a partially vertical side view of FIG. 23.

Next, a structure of each socket 22 of the illuminative lamp 14 of the showcase 1 according to the present invention will be described with reference to FIGS. 5 to 25. FIG. 5 is a side view of the socket 22 attached to one side of the showroom 5; FIG. 6 is a partially see-through sectional view of the socket 22 of FIG. 5; FIG. 7 is a perspective view of a main body side socket member 23; FIG. 8 is a side view of the main body side socket member 23; FIG. 9 is a side view of a housing 25 of the main body side socket member 23; FIG. 10 is a side view of a lid member 26 of the main body side socket member 23; FIG. 11 is a plan view of FIG. 8 viewed from below; FIG. 12 is a front view of the main body side socket member 23; FIG. 13 is a diagram showing that a feeder line 36 is attached to FIG. 11; FIG. 14 is a perspective view of an illuminative lamp side socket member 24; FIG. 15 is a side view of the illuminative lamp side socket member 24; FIG. 16 is a diagram of FIG. 15 viewed from the right; FIG. 17 is a diagram of FIG. 15 viewed from the backside; FIG. 18 is a diagram of FIG. 15 viewed from below; FIG. 19 is an enlarged sectional view of a cover portion; FIG. 20 is a schematic diagram showing that the feeder lines 36 and the illuminative lamp 14 are attached to the sockets 22; FIG. 21 is an electric wiring line diagram; FIG. 22 is a partially cut perspective view showing that the socket 22 is attached to the lower surface of the shelf 8 as viewed from below; FIG. 23 is an enlarged perspective view showing that the socket 22 is attached to the lower surface of the shelf 8 as viewed from below; FIG. 24 is a partially vertical side view of FIG. 23; and FIG. 25 is an enlarged perspective view showing that the socket 22 is attached to an end portion of the shelf 8 as viewed from below.

In the present embodiment, the sockets 22 disengageably fix the illuminative lamp 14 having terminals 14A for receiving the power at end portions to a main body side of the showcase 1, that is, the lower surface of the shelf 8 in the present embodiment. Each socket 22 is constituted of the main body side socket member 23 and the illuminative lamp side socket member 24.

The main body side socket member 23 is constituted of the housing 25 opened inwards, and the lid member 26 which blocks an opening in the housing 25. In the housing 25, a main body side attachment surface 28 which abuts on and is attached to the lower surface of the shelf 8, a connecting portion 29 protruding downwards from the main body side attachment surface 28 and a capacitor storage portion 30 formed at a rear end of the main body side attachment surface 28 are integrally molded of a hard synthetic resin. The connecting portion 29 and the capacitor storage portion 30 communicate with each other, and open toward the inside of the showroom 5.

Moreover, a capacitor 34 is stored in the only capacitor storage portion 30 of one socket 22 of the sockets 22 attached to the opposite ends of the illuminative lamp 14.

The connecting portion 29 formed in the housing 25 is provided with a partition wall 29A which vertically divides the inside of the housing so as to store two hanging power supply contact pieces (power supply portions) 35, 35 separated from each other by the partition wall 29A. Upper ends of these power supply contact pieces 35 are connected to the feeder lines 36. FIG. 21 shows a connection relation between the feeder lines 36 of the power supply contact pieces 35. That is, in the socket 22 in which the capacitor 34 is stored in the housing 25, one of the feeder lines 36 is connected to the capacitor 34. The other feeder line 36 attached to the lid member 26 is drawn outwards, and connected to a power source 37 disposed in the machine room 17 of the showcase 1. In the socket 22 in which the capacitor 34 is not stored in the housing 25, both of the feeder lines 36 attached to the lid member 26 are drawn outwards. Subsequently, one of the feeder lines is connected to the capacitor 34 of the socket 22 in which the capacitor 34 is stored, and the other feeder line 36 is connected to the power source 37 as described above.

In consequence, the capacitor 34, which has heretofore been attached to a certain place in the showroom or the showcase separately from the socket, can be stored in the socket 22. The capacitor 34 connected to the illuminative lamp 14 via the feeder line 36 does not have to be separately disposed in the showcase 1. Therefore, a wiring line treatment of the feeder line 36 can be simplified. Moreover, the number of the components can be reduced, and an assembly operability can be improved.

The power supply contact pieces 35 are constituted of an elastic material. Both of the power supply contact pieces 35, 35 are formed so that, as shown in FIGS. 6 and 9, the pieces are bent toward the center of the connecting portion 29 and come close to each other, then the power supply contact piece 35 stored in a side part of the connecting portion 29, that is, a front part of the main body side socket member 23 is turned forwards (to the left in FIG. 6), and the power supply contact piece 35 stored on a rear side is turned rearwards (to the right in FIG. 6). Furthermore, both of the pieces protrude toward an inner wall of the connecting portion 29 so that the pieces come close to the inner wall.

Moreover, a lower surface of this connecting portion 29 is provided with an inserting portion 39 for inserting the terminals 14A for receiving the power of the illuminative lamp 14 from a lower end of the connecting portion in a state in which the partition wall 29A is interposed. Therefore, the terminals 14A inserted from the inserting portion 39 formed at the lower end of the connecting portion 29 can enter the connecting portion 29 to which the power supply contact pieces 35 are attached.

Furthermore, in front and rear surfaces of this connecting portion 29, cutouts 29B, 29B are formed at a predetermined height from the lower end as shown in FIG. 12, specifically, up to the height at which the turned-back end surfaces of the power supply contact pieces 35 stored in the connecting portion 29 come close to the inner wall of the connecting portion 29.

In addition, before and after this connecting portion 29 (as shown on the left and right sides in FIG. 9), engagement claws (engagement portions) 40, 40 hanging and then protruding inwards at lower ends are formed integrally with the housing 25. Since the engagement claws 40, 40 are inserted so as to disengageably engage with engagement claws 41, 41 formed at the illuminative lamp side socket member 24 described later, a predetermined space is formed between each engagement claw 40 and the connecting portion 29.

On the other hand, at a front end of the main body side attachment surface 28 of the housing 25, an auxiliary engagement portion 31 is formed so as to disengageably engage with the attachment piece 50 of the lower surface of the shelf 8 or the end portion attaching piece 67. This auxiliary engagement portion 31 is inclined at an angle substantially equal to that of the attachment piece 50 or 67 as described above, and formed so as to open toward the attachment piece 50 or 67.

Furthermore, the capacitor storage portion 30 of the housing 25 is inclined downwards and rearwards with respect to the main body side attachment surface 28. The rear surface of this capacitor storage portion 30 is inclined at a predetermined angle so that the portion can be attached along a front wall 32A of the reinforcement plate 32 formed at the lower surface of the shelf 8 and having a substantially trapezoidal sectional shape. As shown in FIG. 22, the reinforcement plate 32 is provided with an engagement hole 51 and a screw hole 52 in positions where the socket 22 is attached. On the other hand, the rear surface of the capacitor storage portion 30 is provided with a holding protrusion 33 which is formed so as to protrude toward the front wall 32A of the reinforcement plate 32.

It is to be noted that the holding protrusion 33 is provided with a cutout 33A (shown in FIG. 22 only) having a predetermined dimension and formed substantially in the same plane as that of the rear surface of the capacitor storage portion 30 so as to be directed inwards. After the holding protrusion is inserted into the engagement hole 51 formed in the reinforcement plate 32, the socket 22 is slid in a cutout direction, that is, outwards. Subsequently, a screw hole 47 formed in the lid member 26 as described later is superimposed on the screw hole 52 formed in the reinforcement plate 32 to engage the holes with each other via a screw 53. In consequence, the socket 22 can securely be fixed to the reinforcement plate 32.

Moreover, the front surface of the capacitor storage portion 30 is an inclined surface 30A which is formed externally (on a rear side in the present embodiment) from the engagement claw 40 positioned on the rear side of the connecting portion 29 and which is continuously formed integrally with the claw. Moreover, when the engagement claw 40 engages with the engagement claw 41 of the illuminative lamp side socket member 24, the inclined surface 30A disengages while inclining so as to form an acute angle. In consequence, a finger insertion space capable of passing fingers is formed between the inclined surface 30A and the engagement claw 41 of the illuminative lamp side socket member 24.

On the other hand, as shown in FIG. 10, the lid member 26 is formed so as to substantially constitute openings and outer shapes similar to those of the connecting portion 29 of the housing 25 and the capacitor storage portion 30. In a position corresponding to a lid portion of the connecting portion 29 of the housing 25, a cutout 42 for terminal insertion is formed which corresponds to the inserting portions 39 and the partition wall 29A formed in the housing 25. Furthermore, at an upper portion of the connecting portion 29, a flange 44 is formed which abuts on an upper edge of the illuminative lamp side socket member 24.

Moreover, the lid member 26 is provided with a feeder line drawing port 26A at a position corresponding to a rear portion of the main body side attachment surface 28 of the housing 25. Furthermore, at a position corresponding to a lid member of the capacitor storage portion 30, as shown in FIG. 7, a lid side capacitor storage portion 45 is formed so as to open toward the capacitor storage portion 30. In addition, a rear end of the lid side capacitor storage portion 45 is provided with a fixing portion 46 substantially having the same plane as that of the rear surface of the capacitor storage portion 30 of the housing 25. This fixing portion 46 is provided with the screw hole 47 and an earth terminal fixing portion 48 (shown in FIGS. 11 and 12) which abut on the reinforcement plate 32 attached to the lower surface of the shelf 8 as described above to engage with the screw hole 52 formed in the reinforcement plate 32.

Therefore, as described above, a terminal 69 for earth drawn from the power source 37 to the main body side socket member 23 together with the feeder lines 36 is stably fixed to the terminal fixing portion 48 for earth as shown in FIGS. 13 and 20. In consequence, the terminal 69 for earth can safely and easily be fixed to the main body side socket member 23, and a wiring line treatment of the terminal 69 for earth can be simplified.

Next, the illuminative lamp side socket member 24 will be described with reference to FIGS. 14 to 19. The illuminative lamp side socket member 24 is made of a hard synthetic resin in the same manner as in the main body side socket member 23, and constituted of an attachment section 55 to be attached to an end portion of the illuminative lamp 14 and a storage portion 56 formed externally from the attachment section 55.

The attachment section 55 is constituted of a bottomed cylindrical cover portion 57 which surrounds the end portion of the illuminative lamp 14, and a plurality of illuminative lamp holding portions 58 formed so as to protrude inwards from an inner wall of the cover portion 57. The illuminative lamp holding portions 58 are capable of substantially tightly holding an outer periphery of the illuminative lamp 14 inserted into the cover portion 57. Since end portions of the illuminative lamp holding portions 58 on a showroom 5 side, that is, on an insertion side of the illuminative lamp 14 are formed so as to enlarge and open outwards, the end portion of the illuminative lamp 14 is easily inserted.

Figure 26:
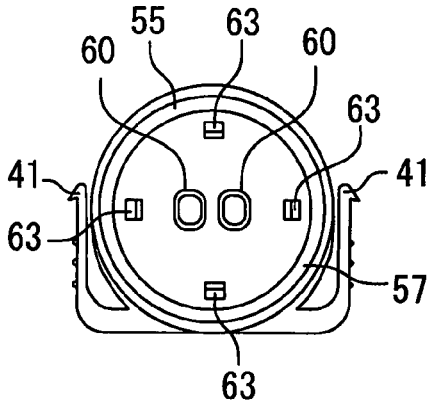
FIG. 26 is a side view of the illuminative lamp side socket member showing an illuminative lamp holding portion as another embodiment.
Figure 27:
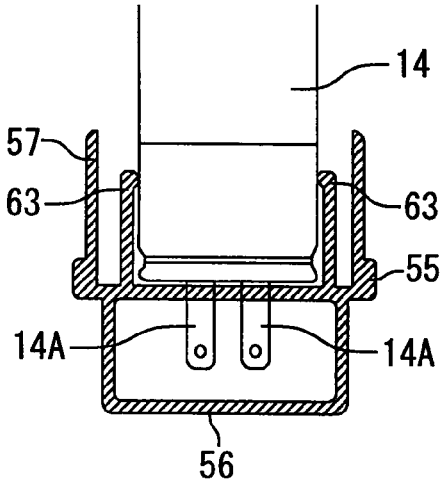
FIG. 27 is a sectional view of FIG. 26.
Figure 28:
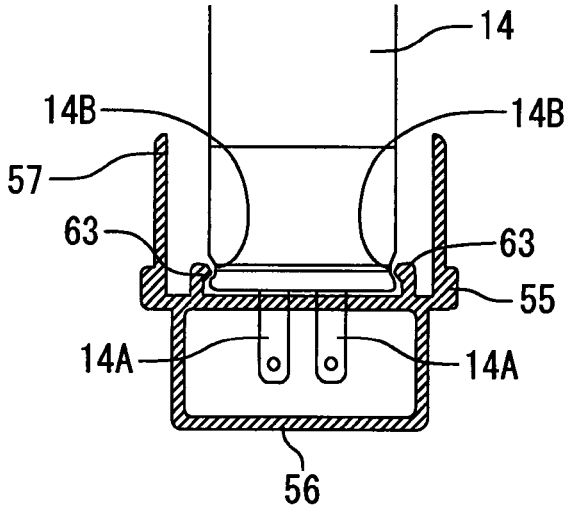
FIG. 28 is a sectional view of FIG. 26.

It is to be noted that the illuminative lamp holding portions 58 formed at the cover portion 57 are not limited to the above shape. For example, as shown in FIG. 26, at a cylindrical bottom surface constituting the cover portion 57, that is, an outer end surface of the cover portion 57, a plurality of (four in FIG. 26) claw-like illuminative lamp holding portions 63 are formed so s to protrude inwards, that is, toward the insertion side of the end portion of the illuminative lamp 14. The end portion of the illuminative lamp 14 may be held by the claw-like illuminative lamp holding portions. At this time, as shown in FIG. 27, the claw-like illuminative lamp holding portions 63 may be formed so as to further protrude from a middle portion of the cover portion 57 to an illuminative lamp 14 side. Alternatively, in a constitution shown in FIG. 28, the holding portions may be constituted so as to engage with grooves 14B formed beforehand at the end portion of the illuminative lamp 14.

According to either of the constitutions, the illuminative lamp holding portions 63 can substantially tightly hold the outer periphery of the illuminative lamp 14 inserted in the cover portion 57.

Moreover, as shown in FIGS. 16 and 19, an outer peripheral surface of this cover portion 57 is provided with thermal insulation cylinder holding portions 59 constituted of a plurality of protrusions substantially formed in parallel with the inserting direction of the illuminative lamp 14 (not shown in FIG. 18). A thermal insulation cylinder 43 is a transparent cylindrical member made of a hard synthetic resin, and surrounds a periphery of the illuminative lamp 14 along the longitudinal direction. The cylinder has a function of thermally separating the illuminative lamp 14 and the showroom 5 from each other, prevents the commodities in the showroom 5 from being adversely affected by heat of the illuminative lamp 14, and further prevents the illuminative lamp 14 itself from being cooled by cool air in the showroom 5 to prevent a drop of illuminance. For this purpose, an outer dimension of the cover portion 57 of the attachment section 55 is formed to be smaller than an inner diameter dimension of the thermal insulation cylinder 43. Since a difference between the outer dimension of the cover portion 57 and the inner diameter dimension of the thermal insulation cylinder 43 is compensated by the protrusions of the thermal insulation cylinder holding portions 59, the thermal insulation cylinder 43 can substantially tightly be held.

Figure 29:
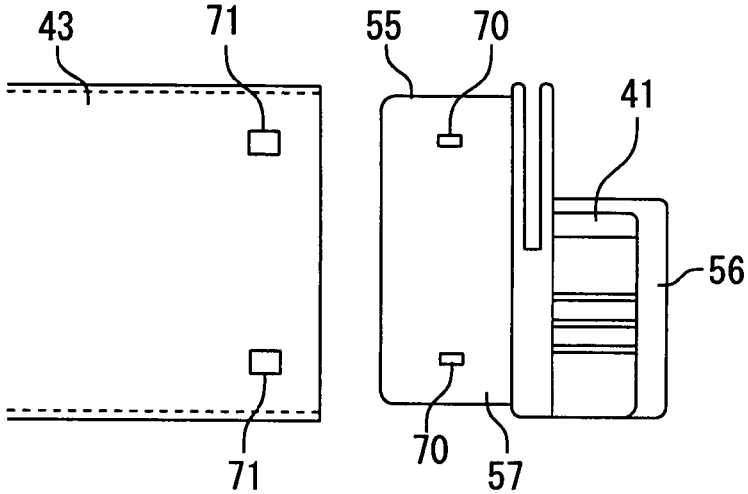
FIG. 29 is an exploded diagram showing a thermal insulation cylinder holding portion

It is to be noted that the thermal insulation cylinder holding portions 59 formed at the outer peripheral surface of the cover portion 57 are not limited to the above shapes. For example, as shown in FIG. 29, the outer peripheral surface of the cover portion 57 is provided with a plurality of protrusions 70 formed so as to protrude outwards. On the other hand, the end portion of the thermal insulation cylinder 43 is provided with openings 71, 71 at positions corresponding to the protrusions 70. The protrusions 70 may be inserted into the openings 71 formed in the thermal insulation cylinder 43 to thereby hold the thermal insulation cylinder 43.

Furthermore, a cylindrical bottom surface constituting the cover portion 57, that is, an outer end surface of the cover portion 57 is provided with terminal insertion holes 60, 60 capable of passing the terminals 14A, 14A for receiving the power which are arranged at the end portion of the illuminative lamp 14. Each terminal insertion hole 60 is formed into an elongated hole by caulking the center of the hole in an only one direction so that a length of the hole along the direction is smaller than that along another direction. Therefore, in a state in which the terminals 14A are inserted, inner edges of the terminal insertion holes 60 are brought into contact under pressure with the terminals 14A. In consequence, the terminals 14A once inserted into the terminal insertion holes 60 do not easily come off.

Figure 30:
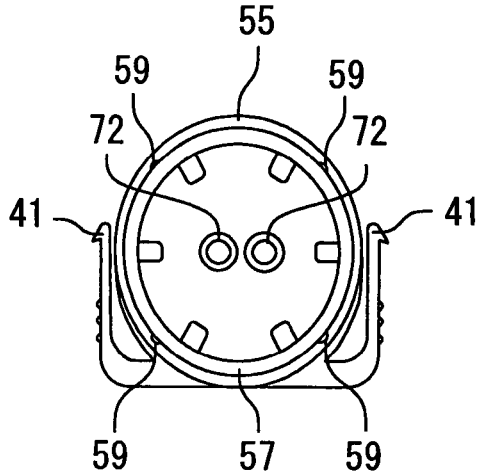
FIG. 30 is a side view showing terminal insertion holes according to another embodiment.

It is to be noted that in the present embodiment, it has been described that the terminal insertion holes 60 formed in the outer end surface of the cover portion 57 have the elongated hole shape, but the present invention is not limited to this embodiment. As shown in FIG. 30, circular terminal insertion holes 72 may be formed into such inner diameters that the holes can substantially tightly engage with outer dimensions of the terminals 14A.

On the other hand, an upper surface of the storage portion 56 formed externally from the attachment section 55 opens, and a storage space for detachably storing the connecting portion 29 of the main body side socket member 23 is formed in the storage portion. The terminals 14A of the illuminative lamp 14 inserted via the terminal insertion holes 60 of the cover portion 57 are allowed to enter the storage space, that is, the storage portion 56.

Moreover, at a lower corner of this storage portion 56, pressing portions 61, 61 formed so as to protrude inwards and upwards are formed integrally with the storage portion 56, respectively. Furthermore, a lower surface of the storage portion 56 is provided with a plurality of drain holes, that is, two drain holes 62, 62 in the present embodiment.

Before and after the storage portion 56 (as shown on the left and right sides in FIG. 17), the engagement claws 41, 41 are formed integrally with the storage portion 56 so that the claws extend outwards, that is, in front and rear directions as much as predetermined dimensions from the lower surface of the storage portion 56, and are then raised substantially at right angles. The engagement claws 41, 41 are constituted of an elastic material which can be pressed inwards centering on a lower end. The engagement claw 41 having an upper end formed outwards, that is, on a front side is formed so as to protrude forwards, whereas the engagement claw 41 formed on a rear side protrudes rearwards. The engagement claws 41, 41 disengageably engage with the engagement claws 40, 40 formed at the main body side socket member 23, respectively, as described above.

Next, an attaching method of the sockets 22 and an attaching method of the illuminative lamp 14 by use of the sockets 22 in the present embodiment will be described. First, the main body side socket member 23 constituting the socket 22 is fixed to the lower surface of the shelf 8.

As shown in FIGS. 3 and 25, to attach the main body side socket member 23 to an end portion of the lower surface of the shelf 8, the holding protrusion 33 formed at the rear surface of the capacitor storage portion 30 of the main body side socket member 23 is inserted along shelf side plate 68 between the reinforcement plate 32 disposed on the lower surface of the shelf 8 and the shelf side plate 68 constituting a shelf side surface, and the attachment surface engagement portion 31 is engaged with the end portion attaching piece 67. Subsequently, the screw hole 47 formed in the fixing portion 46 of the main body side socket member 23 is superimposed on a screw hole formed beforehand in the reinforcement plate 32 to fix the portion via a screw (not shown).

In consequence, in a case where the main body side socket member 23 is constituted of two components, that is, the housing 25 and lid member 26, the attachment surface engagement portion 31 of the lid member 26 is engaged with the end portion attachment piece 67, and the holding protrusion 33 is inserted between the reinforcement plate 32 and the shelf side plate 68. Moreover, the housing 25 is held, by the screw, between the lid member 26 directly fixed to the lower surface of the shelf 8 and the shelf side plate 68. Therefore, even when a downward pulling force is applied to the engagement claws 40, 40 formed at the housing 25, it is possible to avoid disadvantages that the lid member 26 is separated from the housing 25 and that the illuminative lamp 14 attached to the sockets 22 falls.

Moreover, when a rated length dimension of the illuminative lamp 14 is shorter than a width dimension of the showcase 1, the sockets are attached to the showcase 1 in accordance with the length dimension of the illuminative lamp 14. Therefore, the sockets 22 to which the illuminative lamp 14 is attached are not positioned at the end portions of the shelf 8, and can be positioned and attached internally from the end portions.

In this case, as shown in FIGS. 22 and 23, the holding protrusion 33 of the main body side socket member 23 is inserted into the engagement hole 51 formed beforehand in the reinforcement plate 32, and the attachment surface engagement portion 31 is engaged with the attachment piece 50. Subsequently, while the holding protrusion 33 remains to be inserted into the engagement hole 51, the main body side socket member 23 is slid outwards to engage the cutout 33A formed in the holding protrusion 33 with the end surface of the engagement hole 51. In this state, the screw hole 47 formed in the fixing portion 46 of the main body side socket member 23 is superimposed on the screw hole 52 formed beforehand in the reinforcement plate 32 to fix the portion via the screw 53.

In consequence, the attachment surface engagement portion 31 of the housing 25 is engaged with the attachment piece 50, and the holding protrusion 33 is pressed onto the end surface of the engagement hole 51. In this state, the lid member 26 which blocks the opening of the housing 25 is directly fixed to the reinforcement plate 32 via screws. Even in this case, even when the downward pulling force is applied to the engagement claws 40, 40 formed at the housing 25, it is possible to avoid the disadvantages that the lid member 26 is separated from the housing 25 and that the illuminative lamp 14 attached to the sockets 22 falls.

Next, a method of attaching the illuminative lamp 14 and the illuminative lamp side socket member 24 to the main body side socket member 23 constituting the socket 22 will be described. First, the illuminative lamp side socket members 24 are attached to opposite ends of the illuminative lamp 14. At this time, the power receiving terminals 14A of the illuminative lamp 14 are passed through the terminal insertion holes 60, 60 formed in the cover portion 57. Moreover, the terminals 14A are opposed to the storage portion 56 formed externally from the cover portion 57.

Moreover, in the present embodiment, since the inner wall of the cover portion 57 is provided with the illuminative lamp holding portions 58, the illuminative lamp 14 is substantially tightly held in the cover portion 57. Furthermore, since the terminals 14A disposed at the illuminative lamp 14 are passed through the terminal insertion holes 60, the illuminative lamp is also substantially tightly held by the terminal insertion holes 60 having the caulked centers.

In consequence, in a state in which the illuminative lamp side socket members 24 are attached to the end portions of the illuminative lamp 14, the illuminative lamp 14 is held by the illuminative lamp side socket members 24. It is therefore possible to inhibit a disadvantage that the illuminative lamp side socket members 24 easily disengage from the illuminative lamp 14 during the attaching operation.

It is to be noted that in a state in which one illuminative lamp side socket member 24 is attached, the thermal insulation cylinder 43 may be mounted on the illuminative lamp 14. In this case, the end portion of the thermal insulation cylinder 43 is substantially tightly held by the thermal insulation cylinder holding portions 59 formed at the outer peripheral surface of the cover portion 57 of the illuminative lamp side socket member 24. Therefore, it is possible to inhibit a disadvantage that the thermal insulation cylinder 43 falls during the replacement operation of the illuminative lamp 14. The thermal insulation cylinder 43 can easily be attached to the illuminative lamp side socket member 24 together with the illuminative lamp 14.

In a state in which the illuminative lamp side socket members 24 are attached to the opposite ends of the illuminative lamp 14, the illuminative lamp side socket members 24 are attached to the main body side socket members 23. That is, the connecting portion 29 of the main body side socket member 23 is inserted into the storage portion 56 of the illuminative lamp side socket member 24. At this time, since the power receiving terminals 14A of the illuminative lamp 14 are opposed to the storage portion 56, the terminals 14A enter the storage portion from the inserting portion 39 formed at the lower end of the connecting portion 29 to come into contact with the power supply contact pieces 35 stored in the connecting portion 29.

Here, as described above, the power supply contact pieces 35 are formed of the elastic members, and bent toward the center of the connecting portion 29. After both of the power supply contact pieces 35 come close to each other, the pieces are turned sideways in the connecting portion 29. Therefore, the terminals 14A inserted from the inserting portion 39 are urged by elastic forces of the power supply contact pieces 35. In consequence, these terminals 14A are electrically connected to the power supply contact pieces 35.

Especially, in the storage portion 56 of the illuminative lamp side socket member 24 in the present embodiment, the pressing portions 61, 61 are formed at the lower corner. The pressing portions 61, 61 enter the connecting portion 29 from the cutouts 29B formed in the front and rear surfaces of the connecting portion 29. In consequence, the pressing portions 61 come into contact with the power supply contact pieces 35, 35 in the connecting portion 29, and then urges the power supply contact pieces 35 inwards, that is, toward the terminals 14A.

In consequence, the power supply contact pieces 35, 35 are deformed from a state shown by a dot line to a state shown by a solid line in FIG. 6, and the power supply contact pieces 35 can securely be brought into contact with the terminals 14A. Therefore, as compared with a conventional structure, the power supply contact pieces 35 can stably and securely be connected electrically to the terminals 14A of the illuminative lamp 14, and reliability can be improved.

Therefore, even when the force is applied to the terminals 14A of the illuminative lamp 14 attached to the shelf 8 via the sockets 22 in a disengaging direction from the power supply contact pieces 35 stored in the connecting portion 29 of the main body side socket member 23 owing to a weight of the illuminative lamp 14, the pressing portions 61 formed at the storage portion 56 of the illuminative lamp side socket member 24 can firmly press the power supply contact pieces 35 attached to the main body side socket member 23 onto the terminals 14A of the illuminative lamp 14. It is possible to avoid beforehand incomplete lighting due to contact defect and burnout of the terminals 14A or the sockets 22 due to an abnormal temperature rise, and reliability of the socket 22 itself improves.

Moreover, when the connecting portion 29 of the main body side socket member 23 is inserted into the storage portion 56 of the illuminative lamp side socket member 24 to further press upward the illuminative lamp side socket member 24, the engagement claws 41, 41 formed externally from the storage portion 56 engage with the engagement claws 40, 40 formed externally from the connecting portion 29 of the main body side socket member 23.

In consequence, the illuminative lamp side socket member 24 can stably be attached to the main body side socket member 23. Therefore, as compared with a conventional constitution in which the illuminative lamp is held by clips, the illuminative lamp 14 can easily be attached to the lower surface of the shelf 8, and the attaching operation can be simplified. Since the illuminative lamp side socket member 24 is stably engaged with the main body side socket member 23, the terminals 14A of the illuminative lamp 14 can stably be brought into contact with the power supply contact pieces 35 stored in the main body side socket member 23, and illumination can stably and safely be performed.

Moreover, in this case, since the end portion of the illuminative lamp 14 is surrounded with the cover portion 57 of the illuminative lamp side socket member 24, the vicinity of the terminal 14A of the illuminative lamp 14 can be protected. Furthermore, since the end portion of the illuminative lamp 14 is substantially tightly held by the illuminative lamp holding portions 58 of the illuminative lamp side socket member 24 attached to the main body side socket member 23, the illuminative lamp 14 itself can be held by the illuminative lamp side socket member 24. It is possible to inhibit disadvantages that electric connecting portions between the terminals 14A of the illuminative lamp 14 and the power supply contact pieces 35 disposed in the main body side socket member 23 are influenced by the weight of the illuminative lamp 14 as a load and that the contact defect is incurred. In consequence, the terminals 14A of the illuminative lamp 14 can securely electrically be connected to the power supply contact pieces 35.

Furthermore, since the terminals 14A of the illuminative lamp 14 are brought into contact under pressure with the inner edges of the terminal insertion holes 60 formed in the cover portion 57 of the illuminative lamp side socket member 24, the terminals 14A themselves are stably held in the cover portion 57. Even in this case, it is also possible to inhibit the disadvantages that the electric connecting portions between the terminals 14A of the illuminative lamp 14 and the power supply contact pieces 35 disposed in the main body side socket member 23 are influenced by the weight of the illuminative lamp 14 as the load and that the contact defect is incurred. In consequence, the terminals 14A of the illuminative lamp 14 can securely electrically be connected to the power supply contact pieces 35.

In addition, the end portions of the thermal insulation cylinder 43 which surrounds the periphery of the illuminative lamp 14 are substantially tightly held by the thermal insulation cylinder holding portions 59 formed on the outer peripheral surface of the cover portion 57 of the illuminative lamp side socket member 24. Therefore, the cool air in the showroom 5 does not easily enter the thermal insulation cylinder 43 in which the illuminative lamp 14 is stored, and it is possible to inhibit an illuminance drop from being caused by exposing the illuminative lamp 14 to the cool air to lower the temperature. The condensation collected on the surface of the thermal insulation cylinder 43 is also inhibited from entering the thermal insulation cylinder 43, and the condensation does not easily enter the terminals 14A and the like attached to the illuminative lamp side socket member 24. According to this constitution, the illuminative lamp 14 can safely be used.

Moreover, even in a case where the thermal insulation cylinder 43 is not attached and the condensation collected on the illuminative lamp 14 and the surface of the socket 22 enters the illuminative lamp side socket member 24, especially the storage portion 56 in which the terminals 14A are stored, since the drain holes 62 are formed in the lower surface of the storage portion 56, the condensation is not attached to the terminals 14A, and can easily and smoothly be discharged from the drain holes 62. Therefore, it is possible to inhibit short-circuit due to the condensation, and the illuminative lamp 14 can safely be used.

On the other hand, to release the engagement between the main body side socket member 23 and the illuminative lamp side socket member 24, an index finger or a middle finger is inserted into the finger insertion space formed between the inclined surface 30A formed on the front surface of the capacitor storage portion 30 of the main body side socket member 23 and the rear engagement claw 41 formed at the illuminative lamp side socket member 24, and the front engagement claw 41 is touched with a thumb. Moreover, when the engagement claw 41 is manually pressed inwards, the engagement claw 41 is deformed inwards to release the engagement with the engagement claw 40.

At this time, for example, a first joint of the index finger or the middle finger inserted into the finger insertion space abuts on the inclined surface 30A to thereby apply a principle of a lever by use of the abutment portion as an axis. In consequence, the engagement claw 41 can be pressed inwards with a smaller force to release the engagement. Therefore, a trouble in the engaging operation of the main body side socket member 23 with the illuminative lamp side socket member 24 can be eliminated, and the attaching operation of the illuminative lamp 14 can be simplified.

Embodiment 2

Figure 31:
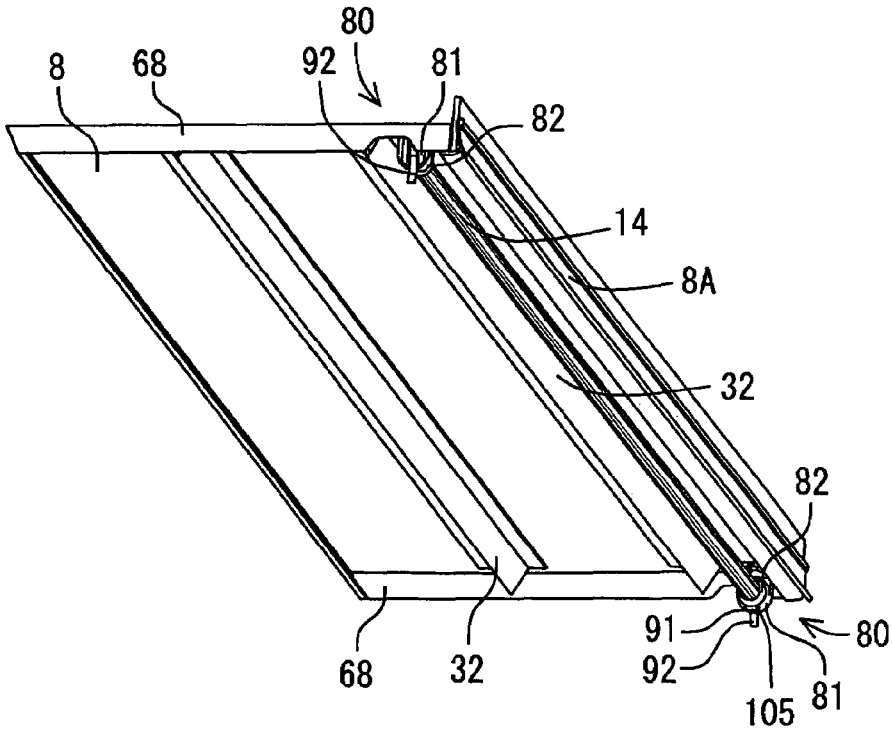
FIG. 31 is a perspective view of a shelf lower surface to which sockets are attached (Embodiment 2)
Figure 32:
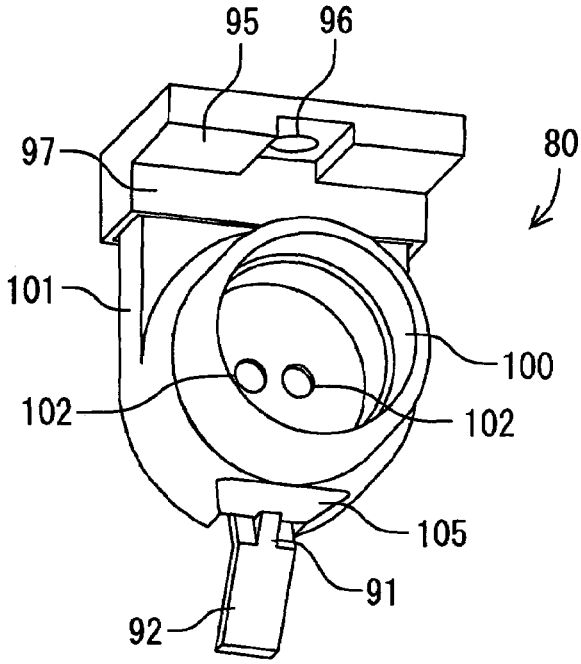
FIG. 32 is a perspective view of the socket (Embodiment 2)
Figure 33:
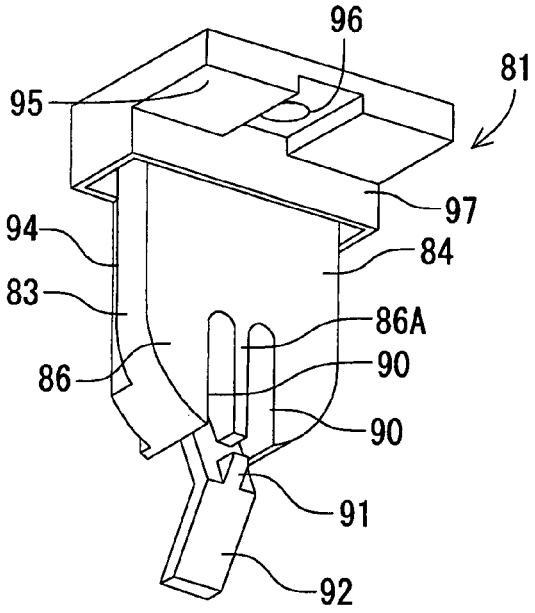
FIG. 33 is a perspective view of a main body side socket member (Embodiment 2)
Figure 35:
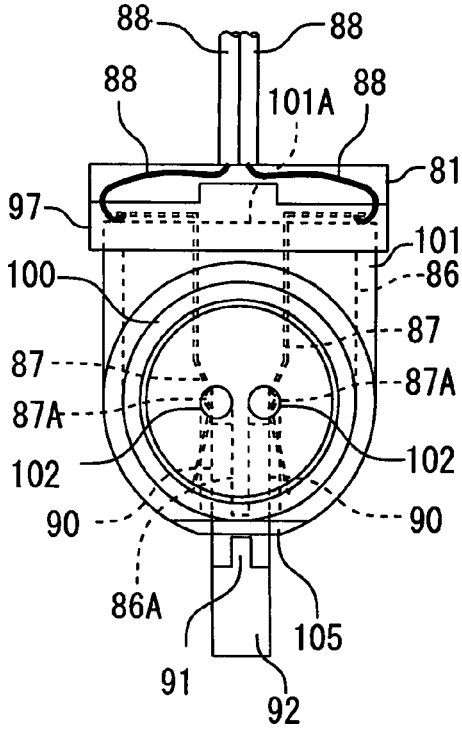
FIG. 35 is a partially see-through side view of the socket of FIG. 32 (Embodiment 2)
Figure 34:
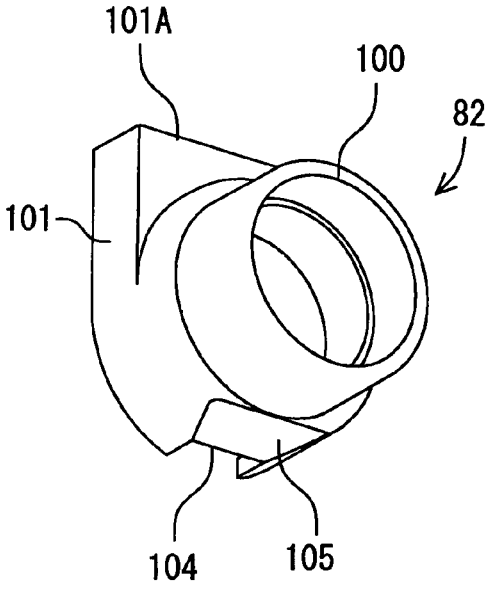
FIG. 34 is a perspective view of an illuminative lamp side socket member (Embodiment 2)
Figure 36:
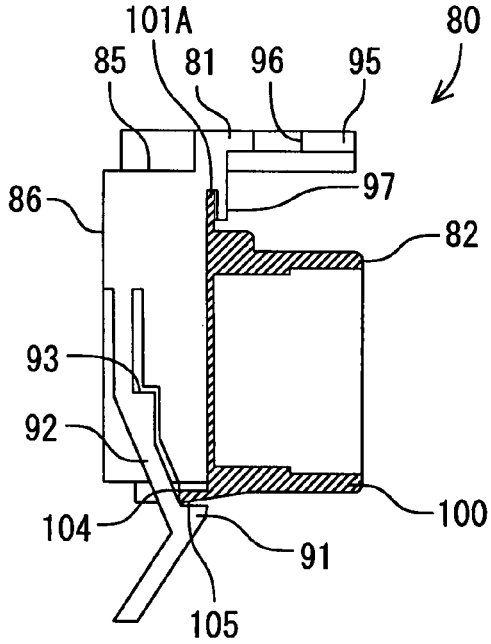
FIG. 36 is a sectional view of FIG. 32 as viewed from the left (Embodiment 2)
Figure 37:
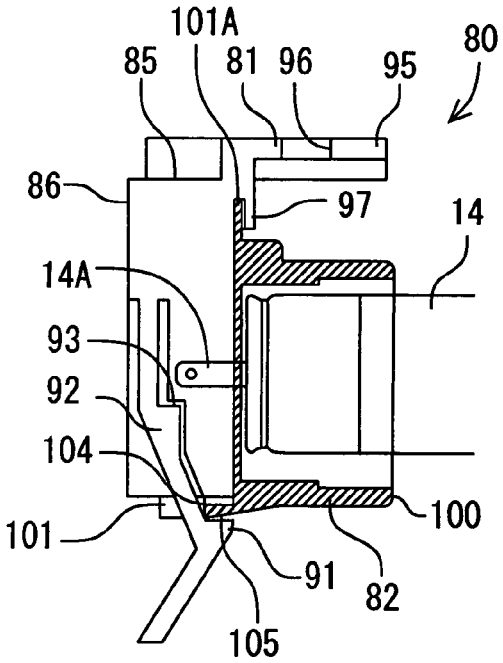
FIG. 37 is a sectional view in a state in which an illuminative lamp is attached to FIG. 36 (Embodiment 2)

Next, a structure of each socket 80 of an illuminative lamp 14 of a showcase will be described in accordance with Embodiment 2 with reference to FIGS. 31 to 37. It is to be noted that since a constitution of the whole showcase is similar to that of the above embodiment, description thereof is omitted. FIG. 31 is a perspective view of a lower surface of a shelf 8 to which the sockets are attached; FIG. 32 is a perspective view of the socket 80; FIG. 33 is a perspective view of a main body side socket member 81; FIG. 34 is a perspective view of an illuminative lamp side socket member 82; FIG. 35 is a partially see-through side view of the socket 80 of FIG. 32; FIG. 36 is a sectional view of FIG. 32 as viewed from the left; and FIG. 37 is a sectional view in a state in which the illuminative lamp 14 is attached to FIG. 36.

In Embodiment 2, the sockets 80 disengageably fix the illuminative lamp 14 having terminals 14A for receiving power at end portions to a main body side of a showcase 1, that is, the lower surface of the shelf 8 in the present embodiment. Each socket 80 is constituted of the main body side socket member 81 and the illuminative lamp side socket member 82.

The main body side socket member 81 is constituted of a housing 83 which opens inwards, and a lid member 84 which blocks an opening in the housing 83, and each of the housing and the lid member is molded of a hard synthetic resin.

The housing 83 has a connecting portion 86 which hangs from the lower surface of the shelf 8, and the connecting portion 86 is provided with a partition wall 86A to vertically divide the inside of the portion so that two hanging power supply contact pieces (power supply portions) 87, 87 are stored separately via the partition wall 86A. Upper ends of these power supply contact pieces 87 are connected to feeder lines 88, respectively. The feeder lines 88 are drawn out of a feeder line drawing portion 85 formed in an upper surface of the housing 83.

It is to be noted that in the present embodiment, unlike the above embodiment, the main body side socket member 81 is not provided with a storage portion in which a capacitor is stored. It is therefore assumed that the feeder lines 88 are connected to a capacitor separately disposed in the showcase, and then connected to a power source.

The power supply contact pieces 87 are constituted of an elastic material. Both of the power supply contact pieces 87, 87 are formed so that, as shown in FIG. 35, the pieces are bent toward the center of the connecting portion 86, come close to each other, and then bent outwards so as to enlarge an interval between the power supply contact pieces 87 and 87. It is to be noted that in a position where both of the power supply contact pieces 87, 87 come close to each other, terminal holding portions 87A are formed along outer shapes of the terminals 14A of the illuminative lamp 14. Moreover, a lower surface of this connecting portion 86 is provided with inserting portions 90 separated from each other via the partition wall 86A so that the power receiving terminals 14A of the illuminative lamp 14 are inserted from lower ends. Therefore, the terminals 14A inserted from the inserting portions 90 formed at the lower ends of the connecting portion 86 can enter the connecting portion 86 provided with the power supply contact pieces 87.

On the other hand, on a side surface positioned externally from this connecting portion 86, an operating portion 92 provided with an engagement claw (an engagement portion)

91 at a lower portion and having elasticity is formed. An upper end of this operating portion 92 is formed continuously from the connecting portion 86. Moreover, an upper portion of the operating portion is inclined inwards, that is, toward the illuminative lamp 14. The operating portion 92 positioned so as to correspond to a lower portion of an inner side surface of the connecting portion 86 is provided with the engagement claw 91 which protrudes inwards. This engagement claw 91 is formed so as to extend to a corresponding position of an inner side surface of the inserting portion 90. Moreover, an upper surface of the engagement claw 91 is disposed at a predetermined interval from a lower end of the partition wall 86A formed at the connecting portion 86. Moreover, a lower end of the operating portion 92 provided with the engagement claw 91 is again inclined outwards. In consequence, the operating portion 92 having the engagement claw 91 is formed so as to extend externally from the connecting portion 86, that is, extend downwards in the present embodiment.

Moreover, at a middle portion of the operating portion 92 which corresponds to a position where the terminals 14A of the illuminative lamp 14 entering from the inserting portions 90 of the connecting portion 86 as described above are fixed, as shown in FIGS. 36 and 37, a terminal holding portion 93 is formed so as to protrude inwards.

Furthermore, sliding surfaces 94 of the illuminative lamp side socket member 82 cut over a vertical direction are formed at front and rear end portions of an outer surface of the connecting portion 86.

On the other hand, the lid member 84 is formed into a shape substantially similar to an inner surface shape of the housing 83. Moreover, an upper end of the lid member 84 is provided with a fixing portion 95 which extends inwards. In the fixing portion 95, an engagement hole 96 is formed so as to fix the fixing portion to the lower surface of the shelf 8 via a screw.

It is to be noted that an opening of the housing 83 is blocked with the lid member 84 in a state in which the power supply contact pieces 87 and the feeder lines 88 are arranged in the housing 83. It is assumed that a bonding surface between the housing 83 and the lid member 84 is integrally adhered. In a state in which the housing 83 and the lid member 84 are integrated, an upper portion of the connecting portion 86 is provided with a flange 97 so that a gap having a predetermined dimension is formed between the flange and the outer peripheral surface of the connecting portion 86.

On the other hand, in the same manner as in the main body side socket member 81, the illuminative lamp side socket member 82 is made of a hard synthetic resin, and constituted of an attachment section 100 to be attached to the end portion of the illuminative lamp 14 and a storage section 101 formed externally from the attachment section 100.

The attachment section 100 is formed into a bottomed cylindrical shape which surrounds the end portion of the illuminative lamp 14. Moreover, in a cylindrical bottom surface constituting this attachment section 100, that is, an outer end surface of the attachment section 100, terminal insertion holes 102, 102 are formed through which the power receiving terminals 14A, 14A disposed at the end portion of the illuminative lamp 14 can be inserted.

On the other hand, an upper surface and an external side surface of the storage section 101 formed externally from the attachment section 100 continuously open, and a storage space for disengageably storing the connecting portion 86 of the main body side socket member 81 is formed in the storage section. The terminals 14A of the illuminative lamp 14 inserted through the terminal insertion holes 102 of the attachment section 100 enter the storage space, that is, the storage section 101. At this time, an upper end 101A of the storage section 101 is formed into such a dimension as to be insertable between the connecting portion 86 of the main body side socket member 81 and the flange 97 as shown in FIG. 33.

Moreover, an external end surface of this storage section 101, that is, an end surface of the storage section opposite to the end surface provided with the attachment section 100 is formed so as to extend slightly inwards. A lower surface of this storage section 101 is provided with an operating portion inserting inlet 104 substantially cut out into a U-shape, and an inner edge portion of the operating portion inserting inlet 104 is an end surface 105 to be engaged with the engagement claw 91 of the operating portion 92.

Next, an attaching method of the sockets 80 and an attaching method of the illuminative lamp 14 by use of the sockets 80 will be described in accordance with the embodiment. First, the fixing portion 95 formed at the lid member 84 of the main body side socket member 81 is attached to the end portion of the lower surface of the shelf 8, and the engagement hole 96 formed in the fixing portion 95 is superimposed on an engagement hole made beforehand in the lower surface of the shelf 8 to fix the fixing portion via a screw (not shown). In consequence, the main body side socket member 81 constituting the socket 80 is fixed to the lower surface of the shelf 8.

Next, the illuminative lamp side socket members 82 are attached to opposite ends of the illuminative lamp 14. At this time, the power receiving terminals 14A of the illuminative lamp 14 are inserted through the terminal insertion holes 102, 102 formed in the attachment sections 100. Moreover, the terminals 14A are opposed to the storage sections 101 formed externally from the attachment sections 100.

It is to be noted that an inner diameter of the attachment section 100 may be formed to be larger than an outer dimension of the illuminative lamp 14 as much as a predetermined dimension, for example, to such an extent that an end portion of a thermal insulation cylinder 43 described in the above embodiment.

In a state in which the illuminative lamp side socket members 82 are attached to the opposite ends of the illuminative lamp 14, the connecting portions 86 of the main body side socket members 81 are inserted into the storage sections 101 formed at the illuminative lamp side socket members 82 from below the main body side socket members 81. At this time, the external side end surfaces of the storage sections 101 can be slid along the sliding surfaces 94 formed at the connecting portions 86 to easily insert the connecting portions 86 into the storage sections 101.

At this time, since the power receiving terminals 14A of the illuminative lamp 14 of the illuminative lamp 14 are opposed to the inside of each storage section 101, the terminals 14A enter the storage section from the inserting portions 90 formed at the lower end of the connecting portion 86, and come into contact with the power supply contact pieces 87 stored in the connecting portion 86. The terminals 14A are held by elastic forces of the power supply contact pieces 87 and the terminal holding portions 87A formed at the power supply contact pieces 87. In consequence, the terminals 14A are electrically connected to the power supply contact pieces 87.

Moreover, while the storage sections 101 of the illuminative lamp side socket members 82 are pushed up toward attachment surfaces of the main body side socket members 81, the end portions of the operating portions 92 formed so as to protrude along tracks of the storage sections 101 are inserted into or disengaged from the operating portion inserting inlets 104 formed in the lower surfaces of the storage sections 101. Since the operating portion 92 is constituted of an elastic material, an inwardly positioned side surface of the operating portion is pressed outwards by an end surface of the operating portion inserting inlet 104, and the operating portion is deformed outwards. Furthermore, when the operating portion is further pushed upwards, the engagement claw 91 formed at the operating portion 92 rides over the lower end of the storage section 101. Since the operating portion 92 is not pressed by anything, the operating portion returns to an initial state, that is, a position corresponding to a side surface positioned inwardly from the inserting portions 90.

In this state, the engagement claw 91 formed at the operating portion 92 is engaged with the end surface 105 formed at the lower end of the storage section 101. At this time, the upper end 101A of the storage section 101 is stored in the gap between the connecting portion 86 formed at the main body side socket member 81 and the flange 97.

In consequence, the illuminative lamp side socket member 82 can stably be attached to the main body side socket member 81. Therefore, as compared with a conventional constitution in which the illuminative lamp is held by clips, the illuminative lamp 14 can easily be attached to the lower surface of the shelf 8, and an attaching operation can be simplified. Since the illuminative lamp side socket member 82 is stably engaged with the main body side socket member 81, the terminals 14A of the illuminative lamp 14 can stably be brought into contact with the power supply contact pieces 87 stored in the main body side socket member 81, and illumination can stably and safely be performed.

Moreover, even in this case, since the end portion of the illuminative lamp 14 is surrounded with the attachment section 100 of the illuminative lamp side socket member 82, the vicinity of each terminal 14A of the illuminative lamp 14 can be protected. Furthermore, in a state in which the operating portion 92 returns to the initial state as shown in FIG. 37, the terminal 14A of the illuminative lamp 14 is held by the terminal holding portion 93. Therefore, it is possible to inhibit disadvantages that electric connecting portions between the terminals 14A of the illuminative lamp 14 and the power supply contact pieces 87 disposed in the main body side socket member 81 are influenced by a weight of the illuminative lamp 14 as a load and that a contact defect is incurred. In consequence, the terminals 14A of the illuminative lamp 14 can securely electrically be connected to the power supply contact pieces 87. In this case, since the terminal 14A of the illuminative lamp 14 can be held by the terminal holding portion 93 formed directly at the operating portion 92, the illuminative lamp 14 may be attached to the main body side socket member 81 without using the illuminative lamp side socket member 82.

On the other hand, to release the engagement between the main body side socket member 81 and the illuminative lamp side socket member 82, the operating portion 92 formed so as to extend outwards, that is, downwards from the socket 80 is pressed outwards. In consequence, the engagement claw 91 formed at the operating portion 92 disengages from the end surface 105. When the illuminative lamp side socket member 82 is pulled downwards in this state, the illuminative lamp side socket member 82 can be disengaged from the main body side socket member 81.

Especially, according to the present embodiment, the operating portion 92 is formed so as to extend downwards from the main body side socket member 81. Therefore, the operating portion has an excellent operability, and it is possible to easily perform an engaging/disengaging operation of the main body side socket member 81 and the illuminative lamp side socket member 82 of the socket 80.

Therefore, according to the present embodiment, not only in a case where the socket 80 is attached to the lower surface of the shelf 8 but also in a case where the socket is attached to a ceiling surface of a showroom 5 or a canopy 15, the operating portion 92 can easily be recognized and operated. Especially, an effect of the operating portion can be exhibited.

Furthermore, the operating portion 92 is formed so as to extend downwards from the main body side socket member 81. Therefore, even when condensation is collected on the socket 80, the condensation can be guided along the socket 80 via the operating portion 92. Since the inwardly accumulated condensation can be discharged from the operating portion inserting inlet 104, it is possible to inhibit in advance disadvantages that drops of water are attached to the terminals 14A of the illuminative lamp 14 and the power supply contact pieces 87 and that short-circuit and the like are incurred.

Embodiment 3

Figure 39:
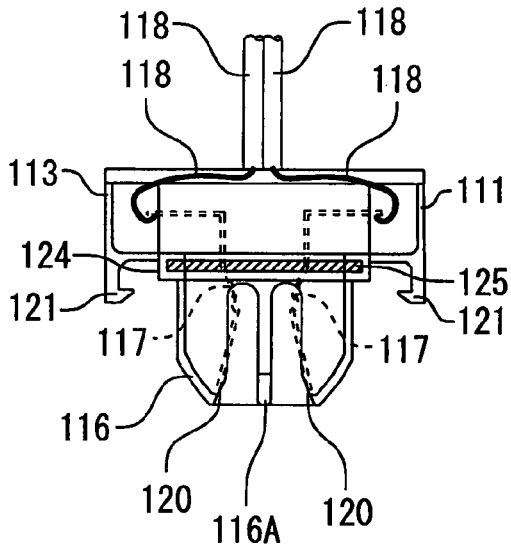
FIG. 39 is an internally see-through side view of a main body side socket member (Embodiment 3)
Figure 38:
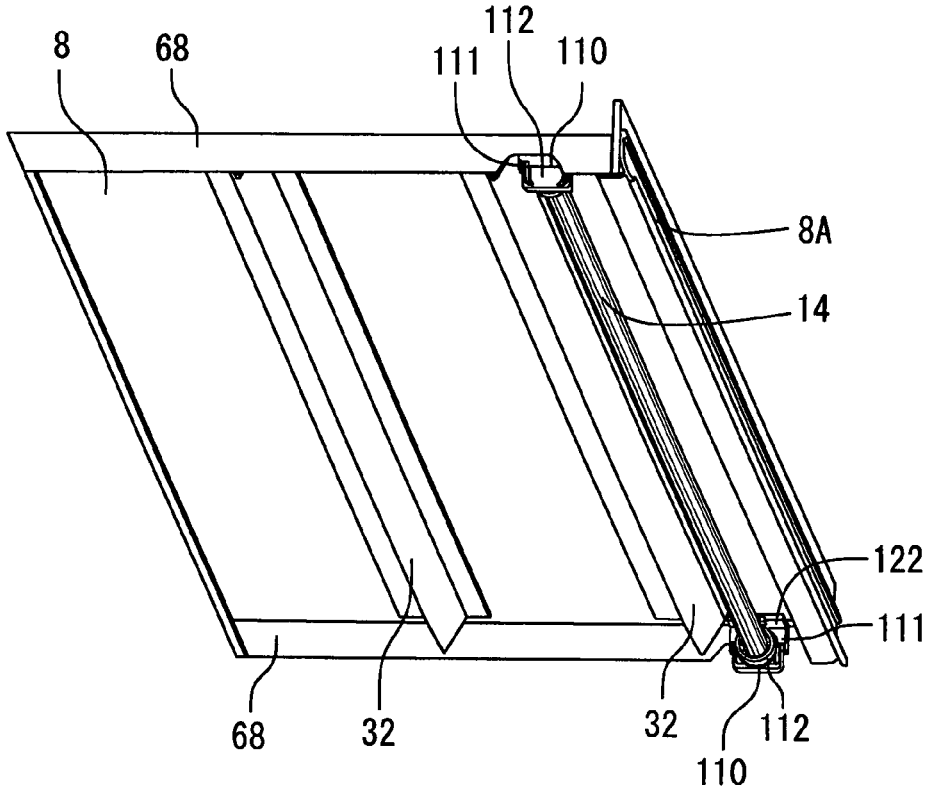
FIG. 38 is a perspective view of a shelf lower surface to which sockets are attached (Embodiment 3)
Figure 40:
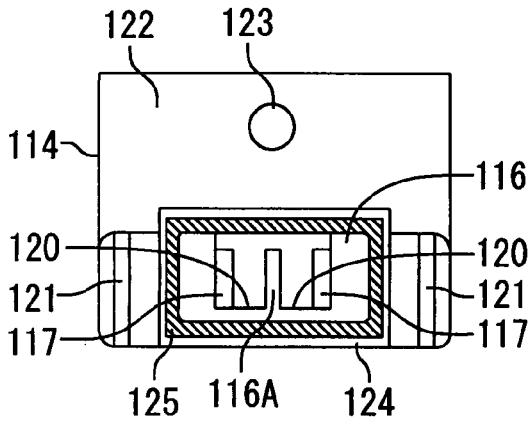
FIG. 40 is a plan view of the main body side socket member viewed from below (Embodiment 3)
Figure 42:
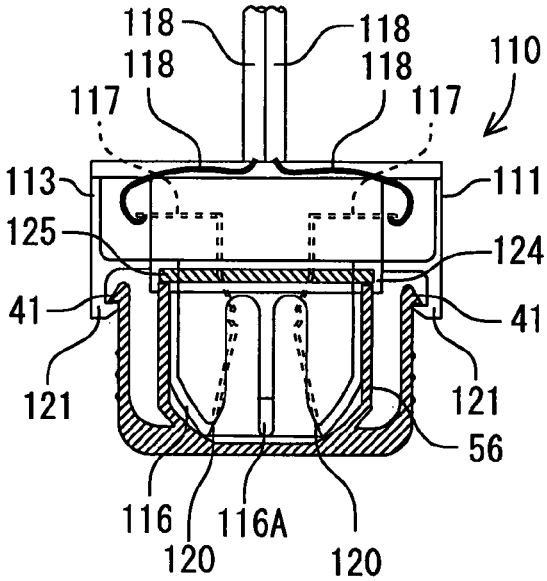
FIG. 42 is a partially see-through side view of the socket (Embodiment 3)
Figure 41:
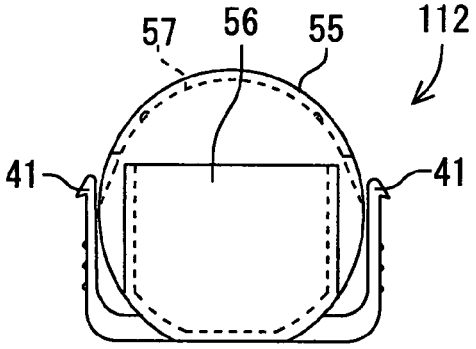
FIG. 41 is a side view of an illuminative lamp side socket member viewed from the outside (Embodiment 3)

Next, a structure of each socket 110 of an illuminative lamp 14 of a showcase will be described in accordance with Embodiment 3 with reference to FIGS. 38 to 42. It is to be noted that since a constitution of the whole showcase is similar to that of the above embodiment, description thereof is omitted. FIG. 38 is a perspective view of a lower surface of a shelf 8 to which the sockets 110 are attached; FIG. 39 is an internally see-through side view of a main body side socket member 111; FIG. 40 is a plan view of the main body side socket member 111 viewed from below; FIG. 41 is a side view of an illuminative lamp side socket member 112 viewed from the outside; and FIG. 42 is a partially see-through side view of the socket 110.

In Embodiment 3, the sockets 110 disengageably fix the illuminative lamp 14 having terminals 14A for receiving power at end portions to a main body side of a showcase 1, that is, the lower surface of the shelf 8 in the present embodiment. Each socket 110 is constituted of the main body side socket member 111 and the illuminative lamp side socket member 112. It is to be noted that the illuminative lamp side socket member 112 of Embodiment 3 has substantially the same constitution as that of the illuminative lamp side socket member 24 of Embodiment 1 described above except that any pressing portion 61 is not formed, and the terminal insertion holes 60 may be formed into either round holes or elongated holes.

The main body side socket member 111 is constituted of a housing 113 which opens inwards, and a lid member 114 which blocks an opening in the housing 113, and each of the housing and the lid member is molded of a hard synthetic resin. The housing 113 has a connecting portion 116 which hangs from the lower surface of the shelf 8, and the connecting portion 116 is provided with a partition wall 116A to vertically divide the inside of the portion so that two hanging power supply contact pieces (power supply portions) 117, 117 are stored separately via the partition wall 116A. It is to be noted that the power supply contact pieces 117 are constituted substantially similarly to the power supply contact pieces 87 described above in Embodiment 2, and description thereof is therefore omitted. Upper ends of these power supply contact pieces 117 are connected to feeder lines 118, respectively. The feeder lines 118 are drawn out of an upper surface of the housing 113.

It is to be noted that in the present embodiment, unlike Embodiment 1 described above, the main body side socket member 111 is not provided with a storage portion in which a capacitor is stored. It is therefore assumed that the feeder lines 118 are connected to a capacitor separately disposed in the showcase, and then connected to a power source.

Moreover, a lower surface of this connecting portion 116 is provided with inserting portions 120 for inserting the power receiving terminals 14A of the illuminative lamp 14 from lower ends separated via the partition wall 116A. Therefore, the terminals 14A to be inserted from the inserting portions 120 formed at the lower ends of the connecting portion 116 can enter the connecting portion 116 to which the power supply contact pieces 117 are attached.

Furthermore, before and after this connecting portion 116 (as shown on the left and right sides in FIGS. 40 and 42), engagement claws (engagement portions) 121, 121 are formed integrally with the housing 113 so that the claws hang, and lower ends of the claws then protrude inwards. Since the engagement claws 121, 121 are disengageably inserted into engagement claws 41, 41 formed at the illuminative lamp side socket member 112, a predetermined space is formed between the engagement claws 121 and the connecting portion 116.

On the other hand, an opening and an outer shape of the lid member 114 are formed substantially similarly to those of the connecting portion 116 of the housing 113. Moreover, at an upper portion of the connecting portion 116, a flange 124 is formed which abuts on an upper end of the illuminative lamp side socket member 112. Furthermore, an upper end of the lid member 114 is provided with a fixing portion 122 formed horizontally to an attachment surface of the shelf 8. The fixing portion 122 is provided with a screw hole 123 which abuts on the lower surface of the shelf 8 to engage with a screw hole made beforehand.

It is assumed that an opening of the housing 113 is blocked with the lid member 114 in a state in which the power supply contact pieces 117 and the feeder lines 118 are arranged in the housing. It is also assumed that a bonding surface between the housing 113 and the lid member 114 is integrally adhered. In a state in which the housing 113 and the lid member 114 are integrated, an upper portion of the connecting portion 116 is provided with the flange 124 so that a gap having a predetermined dimension is formed between the flange and the outer peripheral surface of the connecting portion 116. Moreover, a waterproof rubber 125 constituting a waterproof mechanism is disposed in this gap between the flange 124 and the outer peripheral surface of the connecting portion 116.

An attaching method of the illuminative lamp 14 by use of the sockets 110 constituted as described above will be described in accordance with the embodiment. First, the fixing portion 122 formed at the lid member 114 of the main body side socket member 111 is attached to the end portion of the lower surface of the shelf 8, and the engagement hole 123 formed in the fixing portion 122 is superimposed on an engagement hole made beforehand in the lower surface of the shelf 8 to fix the fixing portion via a screw (not shown). In consequence, the main body side socket member 111 constituting the socket 110 is fixed to the lower surface of the shelf 8.

Next, the illuminative lamp side socket members 112 are attached to opposite ends of the illuminative lamp 14. At this time, the power receiving terminals 14A of the illuminative lamp 14 are inserted through the terminal insertion holes 60, 60 formed in cover portions 57. Moreover, the terminals 14A are opposed to storage portions 56 formed externally from the cover portions 57.

In a state in which the illuminative lamp side socket members 112 are attached to the opposite ends of the illuminative lamp 14, the illuminative lamp side socket members 112 are attached to the main body side socket members 111. That is, the connecting portions 116 of the main body side socket members 111 are inserted into the storage portions 56 of the illuminative lamp side socket members 112. At this time, since the power receiving terminals 14A of the illuminative lamp 14 are opposed to the inside of each storage portion 56, the terminals 14A enter the storage portion from the inserting portions 120 formed at the lower end of the connecting portion 116, and come into contact with the power supply contact pieces 117 stored in the connecting portion 116. The terminals 14A are held by elastic forces of the power supply contact pieces 117 and terminal holding portions 117A formed at the power supply contact pieces 117. In consequence, the terminals 14A are electrically connected to the power supply contact pieces 117.

Moreover, the connecting portion 116 of the main body side socket member 111 is inserted into the storage portion 56 of the illuminative lamp side socket member 112. Furthermore, the illuminative lamp side socket member 112 is pushed upwards. In consequence, the engagement claws 41, 41 formed externally from the storage portion 56 engage with the engagement claws 121, 121 formed externally from the connecting portion 116 of the main body side socket member 111.

In consequence, the illuminative lamp side socket member 112 can stably be attached to the main body side socket member 111. Therefore, as compared with a conventional constitution in which the illuminative lamp is held by clips, the illuminative lamp 14 can easily be attached to the lower surface of the shelf 8, and an attaching operation can be simplified. Since the illuminative lamp side socket member 112 is stably engaged with the main body side socket member 111, the terminals 14A of the illuminative lamp 14 can stably be brought into contact with the power supply contact pieces 117 stored in the main body side socket member 111, and illumination can stably and safely be performed.

Moreover, at this time, the main body side socket member 111 is provided with the flange 124 at a predetermined interval from the outer peripheral surface of the connecting portion 116. Therefore, an upper end of the storage portion 56 of the illuminative lamp side socket member 112 is stored in a gap formed between such a connecting portion 116 and the flange 124. In this case, since the waterproof rubber 125 is disposed between the flange 124 and the connecting portion 116, the waterproof rubber 125 can isolate a contact surface between the storage portion 56 of the illuminative lamp side socket member 112 and the main body side socket member 111 from the outside in a watertight manner.

In consequence, especially in a case where the inside of a showroom 5 is cooled at a predetermined temperature as in the present embodiment, since the main body side socket member is divided by the waterproof rubber 125, it is possible to inhibit short-circuit from being incurred by condensation collected on the surface of the socket 110, entering the illuminative lamp side socket member 112 and attached to the power supply contact pieces 117 and the terminals 14A of the illuminative lamp 14. Therefore, even if the condensation is collected on the illuminative lamp 14 and the socket 110, the illuminative lamp 14 can safely be used.

It is to be noted that to release the engagement between the main body side socket member 111 and the illuminative lamp side socket member 112, the front and rear engagement claws 41, 41 formed at the illuminative lamp side socket member 112 are manually held. The engagement claws 41 are pressed inwards to deform the engagement claws 41 inwards, thereby releasing the engagement between the engagement claws 41 and 121.

It is to be noted that in Embodiments 1 and 3 described above, the engagement between the main body side socket member 23 or 111 and the illuminative lamp side socket member 24 or 112 is performed by engaging the engagement claws 40 (or 121) formed at the main body side socket member 23 (or 111) with the engagement claws 41 formed at the illuminative lamp side socket member 24 (or 112). At this time, a lower end of the engagement claw 40 (or 121) is formed so as to protrude toward the connecting portion 29 (or 116). Moreover, an upper end of the engagement claw 41 is formed so as to protrude outwards. However, the engagement between the main body side socket member and the illuminative lamp side socket member is not limited to this embodiment. Another example will be described hereinafter with reference to FIGS. 43 to 45 or 46 to 48.

Figure 43:
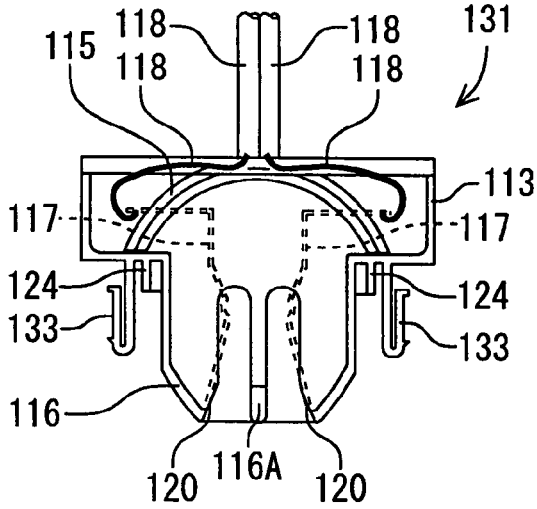
FIG. 43 is an internally see-through sectional view of a main body side socket member constituting a socket according to another embodiment.
Figure 44:
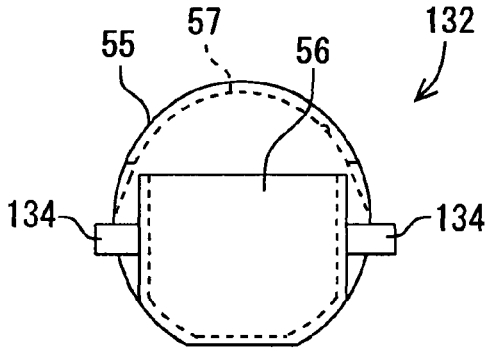
FIG. 44 is a side view of an illuminative lamp side socket member to be attached to the main body side socket member of FIG. 43 as viewed from the outside.
Figure 45:
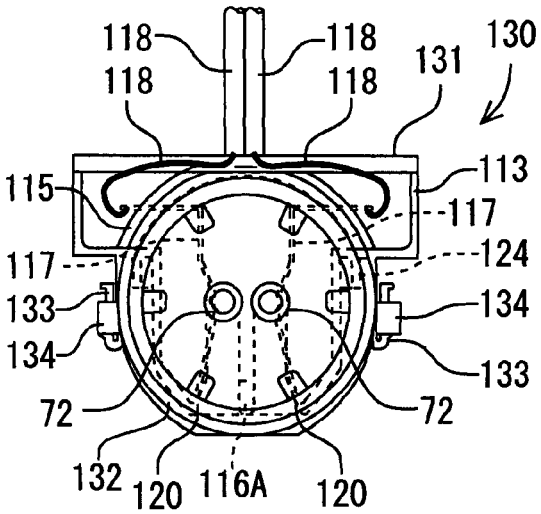
FIG. 45 is a partially see-through sectional view of a socket.

FIG. 43 is an internally see-through sectional view of a main body side socket member 131 constituting a socket 130 according to a first example; FIG. 44 is a side view of an illuminative lamp side socket member 132 to be attached to the main body side socket member 131 of FIG. 43 as viewed from the outside; and FIG. 45 is a partially see-through sectional view of the socket 130. It is to be noted that the socket has a constitution substantially similar to that of the socket 110 of Embodiment 3 except a constitution of an engagement portion and except that any waterproof mechanism is not disposed, and description thereof is therefore omitted.

In this example, engagement claws (engagement portions) 133 are formed at the main body side socket member 131. The claws are positioned before and after a connecting portion 116 (as shown on the left and right sides in FIG. 43) and hang, lower ends of the claws are then turned upwards, and upper ends of the claws protrude outwards. The claws are formed integrally with the connecting portion 116. This engagement claw 133 is also constituted of an elastic material in the same manner as in the above embodiments. When the turned portions are pressed, the claws can be deformed.

On the other hand, engagement portions 134 formed at the illuminative lamp side socket member 132 are positioned on front and back surfaces of a storage portion 56, and protrude outwards. The engagement portions 134 are provided with vertically extending communication holes.

According to such a constitution, the connecting portion 116 of the main body side socket member 131 is inserted into the storage portion 56 of the illuminative lamp side socket member 132. Furthermore, the illuminative lamp side socket member 132 is pushed upwards. In consequence, the lower ends of the engagement claws 133 formed at the main body side socket member 131 are inserted into the engagement portions 134, 134 formed on an outer surface of the storage portion 56. At this time, the engagement claws 133 are constituted of an elastic material formed into an upwardly turned shape. The engagement claws 133 enter the illuminative lamp side socket member 132 from the lower ends. As upper portions of the engagement claws enter the illuminative lamp side socket member, an urging force which expands outwards acts in the engagement portions 134. In consequence, the engagement claws 133 are securely engaged with the engagement portions 134.

In consequence, the illuminative lamp side socket member 132 can stably be attached to the main body side socket member 131. Therefore, the terminals 14A of the illuminative lamp 14 can stably be brought into contact with power supply contact pieces 117 stored in the main body side socket member 131, and illumination can stably and safely be performed.

Figure 46:
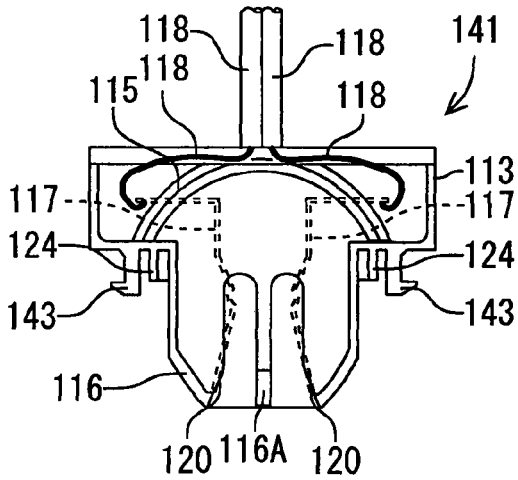
FIG. 46 is an internally see-through sectional view of a main body side socket member constituting a socket according to another embodiment.
Figure 47:
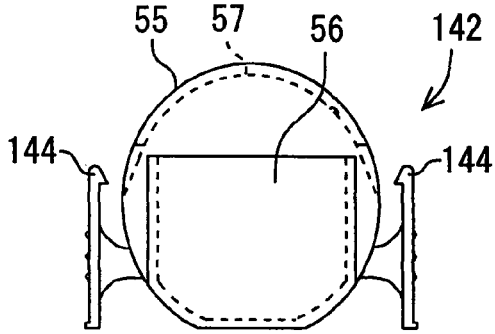
FIG. 47 is a side view of an illuminative lamp side socket member to be attached to the main body side socket member of FIG. 46.
Figure 48:
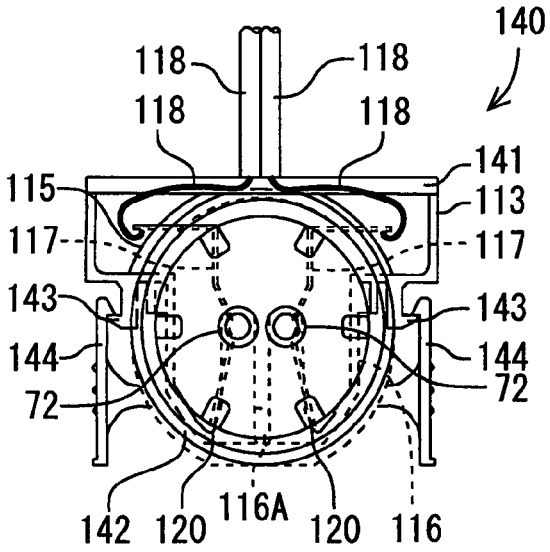
FIG. 48 is a partially see-through sectional view of a socket.

FIG. 46 is an internally see-through sectional view of a main body side socket member 141 constituting a socket 140 according to a second example; FIG. 47 is a side view of an illuminative lamp side socket member 142 to be attached to the main body side socket member 141 of FIG. 46; and FIG. 48 is a partially see-through sectional view of the socket 140. It is to be noted that the socket has a constitution substantially similar to that of the socket 110 of Embodiment 3 except a constitution of an engagement portion and except that any waterproof mechanism is not disposed, and description thereof is therefore omitted.

In this example, engagement claws (engagement portions) 143 formed at the main body side socket member 141 are positioned before and after a connecting portion 116 (as shown on the left and right sides in FIG. 46), and hang. Moreover, lower ends of the engagement claws protrude outwards. That is, the front engagement claw 143 protrudes forwards, the rear engagement claw 143 protrudes rearwards, and the claws are formed integrally with the connecting portion 116. The engagement claws 143 are constituted of an elastic material in the same manner as in the above embodiments.

On the other hand, engagement portions formed at the illuminative lamp side socket member 142 extend as much as a predetermined dimension from front and rear surfaces of a storage portion 56 (as shown on the left and the right of FIG. 47), and are erected substantially at right angles to form engagement pieces (engagement portions) 144, 144 which are formed integrally with the storage portion 56. Each engagement piece 144 is constituted of an elastic material so that the piece can be pressed inwards centering on a connecting portion between the piece and the storage portion 56. Moreover, an upper end of the engagement piece is formed so as to protrude inwards, that is, toward the storage portion 56. It is assumed that a predetermined gap capable of inserting the engagement claws 143 of the main body side socket member 141 is formed between the engagement piece 144 and the storage portion 56.

According to such a constitution, the connecting portion 116 of the main body side socket member 141 is inserted into the storage portion 56 of the illuminative lamp side socket member 142. Furthermore, the illuminative lamp side socket member 142 is pushed upwards. In consequence, the engagement claws 143 which abut on the upper ends of the engagement pieces 144 deform the upper ends of the engagement pieces 144 outwards. Each engagement claw 143 formed on the outer surface of the storage portion 56 is stored between the storage portion 56 and the engagement piece 144. Therefore, the inwardly protruding upper ends of the engagement pieces 144 engage with the outwardly protruding lower ends of the engagement claws 143, and the engagement pieces 144 securely engage with the engagement claws 143 by inwardly directed urging forces of the engagement pieces 144.

In consequence, the illuminative lamp side socket member 142 can stably be attached to the main body side socket member 141. Therefore, the terminals 14A of the illuminative lamp 14 can stably be brought into contact with power supply contact pieces 117 stored in the main body side socket member 141, and illumination can stably and safely be performed.

Embodiment 4

Figure 50:
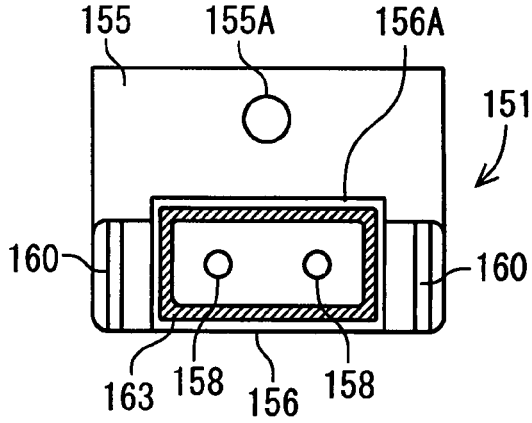
FIG. 50 is a plan view of FIG. 49 viewed from below (Embodiment 4)
Figure 49:
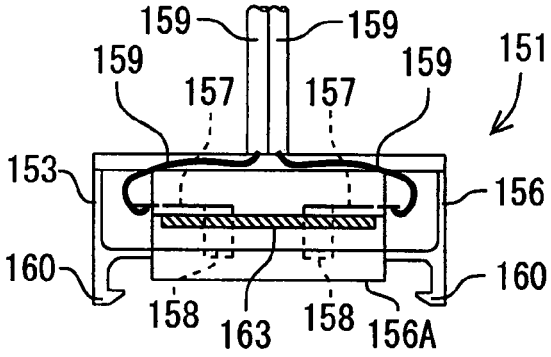
FIG. 49 is a vertically side view of a main body side socket member (Embodiment 4)
Figure 51:
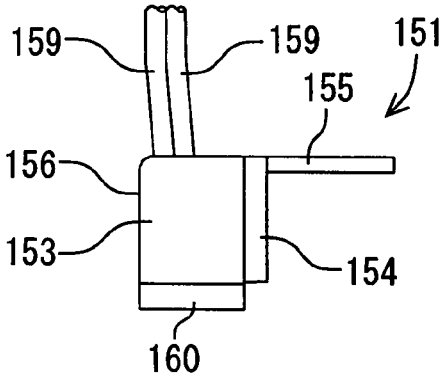
FIG. 51 is a front view of a main body side socket member (Embodiment 4)
Figure 52:
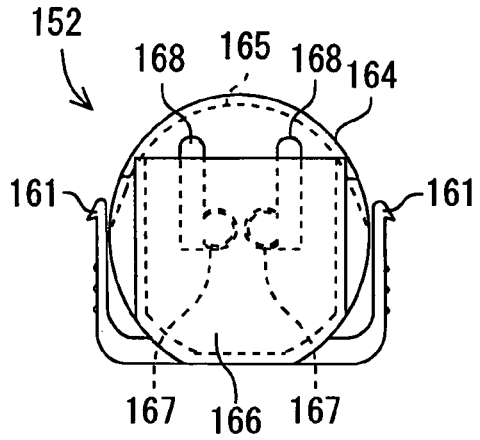
FIG. 52 is an internally see-through side view of an illuminative lamp side socket member viewed from the outside (Embodiment 4)
Figure 55:
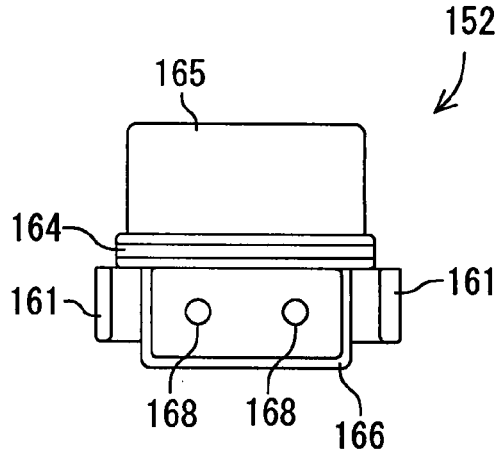
FIG. 55 is a plan view of FIG. 52 viewed from below (Embodiment 4)
Figure 53:
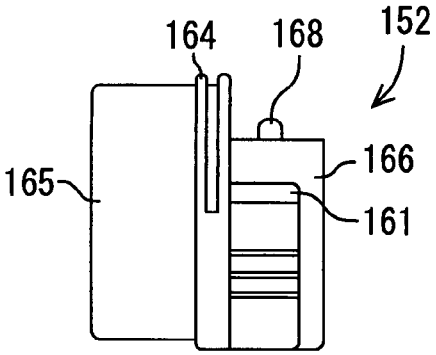
FIG. 53 is a front view of FIG. 52 viewed from the left (Embodiment 4)
Figure 56:
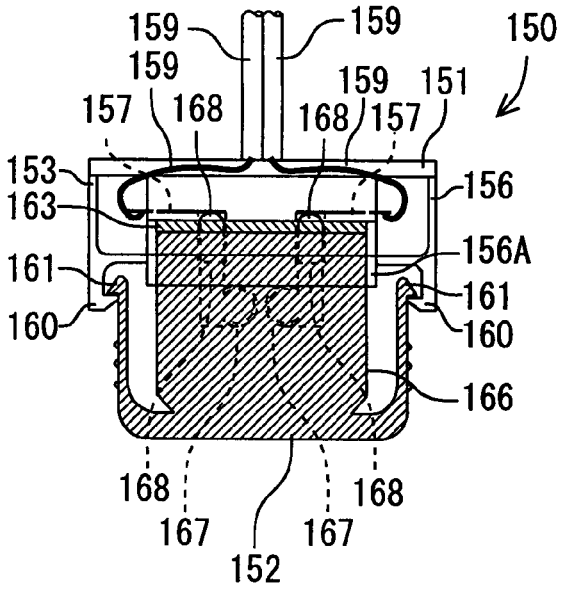
FIG. 56 is a sectional view of a socket (Embodiment 4)
Figure 54:
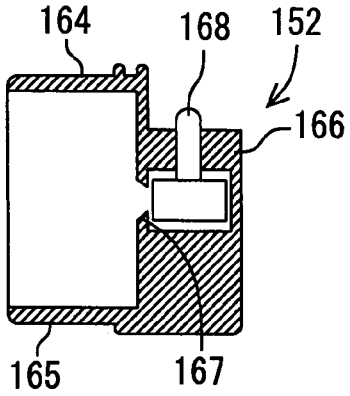
FIG. 54 is a sectional view of FIG. 53 (Embodiment 4)
Figure 57:
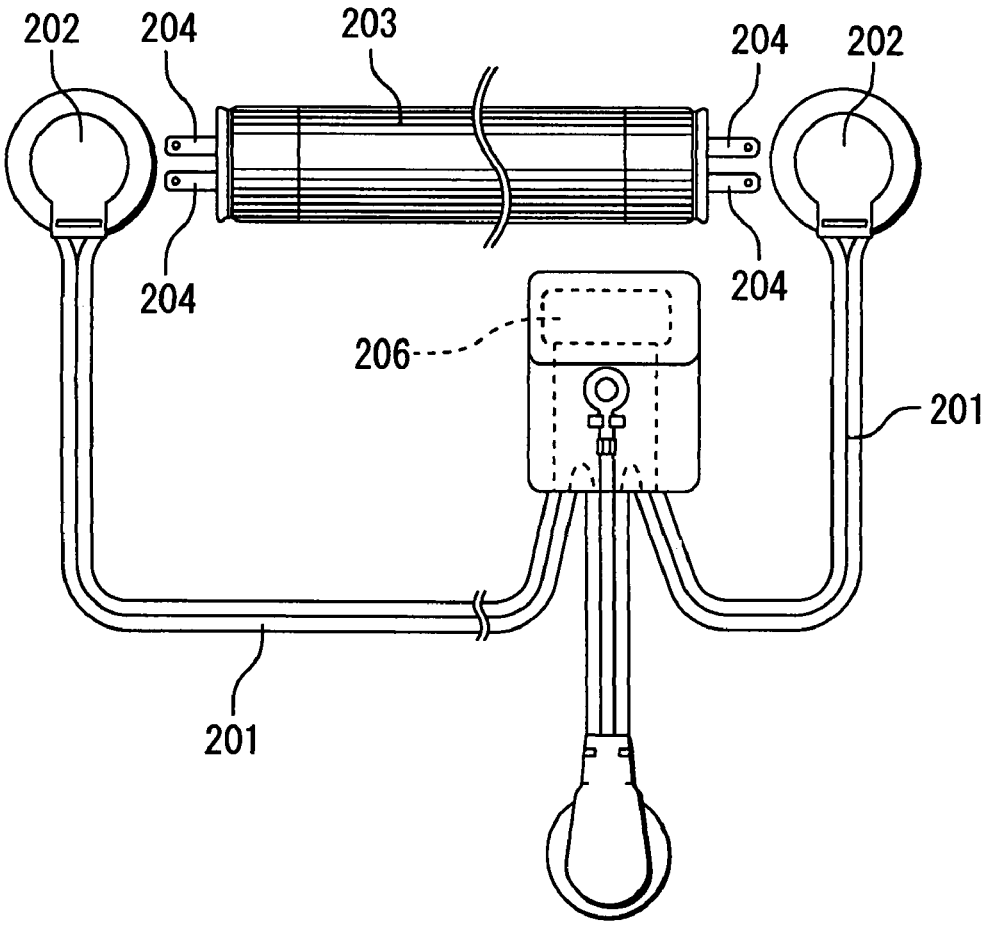
FIG. 57 is a schematic diagram showing that feeder lines and an illuminative lamp are attached to conventional sockets.
Figure 58:
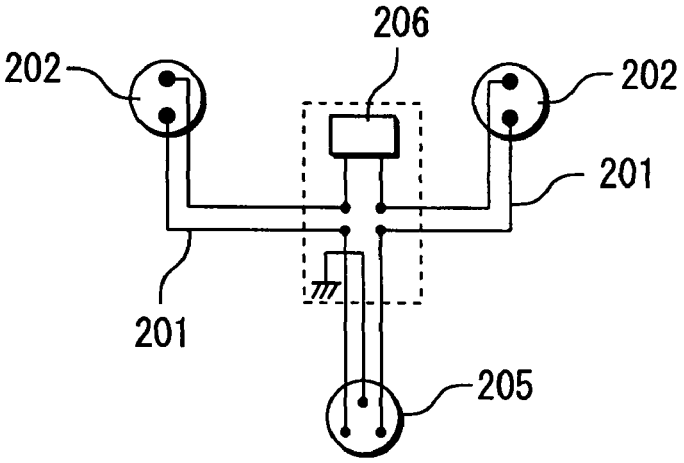
FIG. 58 is an electric wiring line diagram of FIG. 57.

Next, a structure of each socket 150 of an illuminative lamp 14 of a showcase will be described in accordance with Embodiment 4 with reference to FIGS. 49 to 56. It is to be noted that since a constitution of the whole showcase is similar to that of the above embodiment, description thereof is omitted. FIG. 49 is a vertically side view of a main body side socket member 151 constituting the socket 150; FIG. 50 is a plan view of FIG. 49 viewed from below; FIG. 51 is a front view of the main body side socket member 151; FIG. 52 is an internally see-through side view of an illuminative lamp side socket member 152 viewed from the outside; FIG. 53 is a front view of FIG. 52 viewed from the left; FIG. 54 is a sectional view of FIG. 53; FIG. 55 is a plan view of FIG. 52 viewed from below; and FIG. 56 is a sectional view of the socket 150.

In Embodiment 4, the sockets 150 disengageably fix the illuminative lamp 14 having terminals 14A for receiving power at end portions to a main body side of a showcase 1, that is, a lower surface of a shelf 8 in the present embodiment. Each socket 150 is constituted of the main body side socket member 151 and the illuminative lamp side socket member 152.

The main body side socket member 151 is constituted of a housing 153 which opens inwards, and a lid member 154 which blocks an opening in the housing 153, and each of the housing and the lid member is molded of a hard synthetic resin. The housing 153 has a connecting portion 156 having an opening in a lower portion. The connecting portion 156 is internally connected to two power supply contact pieces (power supply portions) 157, 157. Lower ends of the power supply contact pieces 157, 157 are electrically connected to power supply terminals 158, 158, respectively. Power receiving terminals (conductive members) disposed at the illuminative lamp side socket member 152 are inserted into and electrically connected to the power supply terminals 158, 158. The power supply terminals are opposed to an opening formed in a lower surface of the connecting portion 156.

It is to be noted that a downwardly extending flange 156A is formed at an opening edge of this connecting portion 156. The flange 156A surrounds peripheries of the power supply terminals 158, 158. In the connecting portion 156, a waterproof rubber 163 is disposed which has a waterproof function of isolating the inside of the connecting portion 156 provided with the power supply contact pieces 157 from the outside in a watertight manner. On the other hand, upper ends of the power supply contact pieces 157, 157 are connected to feeder lines 159, 159, respectively. The feeder lines 159 are drawn from an upper surface of the housing 153.

It is to be noted that unlike Embodiment 1, the main body side socket member 151 of the present embodiment does not include any storage portion in which a capacitor is stored. Therefore, the feeder lines 159 are connected to the capacitor disposed separately in the showcase, and then connected to a power source.

Moreover, before and after this connecting portion 156 (as shown on the left and right sides in FIGS. 49 and 50), engagement claws (engagement portions) 160, 160 hanging and then projecting lower ends inwards are formed integrally with the housing 153. Since the engagement claws 160, 160 are inserted into the illuminative lamp side socket member 152 so as to disengageably engage with engagement claws 161, 161 formed at the illuminative lamp side socket member, a predetermined space is formed between the engagement claws 160 and the connecting portion 156.

On the other hand, an opening and an outer shape of the lid member 154 are formed to be substantially similar to those of the connecting portion 156 of the housing 153. Moreover, an upper end of the lid member 154 is provided with a fixing portion 155 which is horizontal to an attachment surface of the shelf 8. The fixing portion 155 is provided with a screw hole 155A which abuts on the lower surface of the shelf 8 to engage with a screw hole made beforehand in the lower surface.

It is assumed that an opening of the housing 153 is blocked with the lid member 154 in a state in which the power supply contact pieces 157, the power supply terminals 158 and the feeder lines 159 are arranged in the housing 153. It is also assumed that a bonding surface between the housing 153 and the lid member 154 is integrally adhered.

On the other hand, the illuminative lamp side socket member 152 is made of a hard synthetic resin in the same manner as in the main body side socket member 151, and constituted of an attachment section 164 attached to an end portion of the illuminative lamp 14 and a connecting section 166 formed externally from the attachment section 164.

The attachment section 164 is constituted of a bottomed cylindrical cover portion 165 which surrounds the end portion of the illuminative lamp 14. In a cylindrical bottom surface constituting the cover portion 165, that is, an outer end surface of the cover portion 165, terminal insertion holes 167, 167 are formed which are capable of passing the power receiving terminals 14A disposed at the end portion of the illuminative lamp 14.

On the other hand, the connecting section 166 formed externally from the attachment section 164 is provided with power receiving terminals 168 which protrude upwards from an upper surface of the connecting section 166 and whose lower portions can electrically be connected to the terminals 14A of the illuminative lamp 14 inserted from the terminal insertion holes 167.

Before and after the connecting section 166 (as shown on the left and right sides in FIG. 52), the engagement claws 161, 161 are formed integrally with the connecting section 166. The claws extend as much as a predetermined dimension from the lower surface of the connecting section 166 outwards, that is, in front and rear directions, respectively, and are then erected substantially at right angles. The engagement claws 161, 161 are constituted of an elastic material which can be pressed inwards centering on a lower end. The engagement claw 161 having an upper end formed outwards, that is, on a front side is formed so as to protrude forwards, whereas the engagement claw 161 formed on a rear side protrudes rearwards. The engagement claws 161, 161 disengageably engage with the engagement claws 160, 160 formed at the main body side socket member 151, respectively, as described above.

An attaching method of the illuminative lamp 14 by use of the sockets 150 constituted as described above will be described according to the embodiment. First, the fixing portion 155 formed at the lid member 154 of the main body side socket member 151 is attached to the end portion of the lower surface of the shelf 8, and the engagement hole 155A formed in the fixing portion 155 is superimposed on an engagement hole made beforehand in the lower surface of the shelf 8 to fix the fixing portion via a screw (not shown). In consequence, the main body side socket member 151 constituting the socket 150 is fixed to the lower surface of the shelf 8.

Next, the illuminative lamp side socket members 152 are attached to opposite ends of the illuminative lamp 14. At this time, the power receiving terminals 14A of the illuminative lamp 14 are inserted through the terminal insertion holes 167, 167 formed in cover portion 165. Moreover, the terminals 14A are electrically connected to the power receiving terminals 168 stored in the connecting section 166.

In a state in which the illuminative lamp side socket members 152 are attached to the opposite ends of the illuminative lamp 14, the illuminative lamp side socket members 152 are attached to the main body side socket members 151. That is, the connecting portions 156 of the main body side socket members 151 are connected to the connecting sections 166 of the illuminative lamp side socket members 152. At this time, the power receiving terminals 168, 168 electrically connected to the power receiving terminals 14A of the illuminative lamp 14 are projected from the upper surface of the connecting section 166. Therefore, when these power receiving terminals 168 are fitted into the power supply terminals 158, 158 disposed at the connecting portion 156, the terminals are electrically connected to each other. Since one end of each power supply terminal 158 is electrically connected to the feeder line 159 connected to the power source, the terminals 14A of the illuminative lamp 14 are electrically connected to the power source.

Moreover, the connecting section 166 of the illuminative lamp side socket member 152 is connected to the connecting portion 156 of the main body side socket member 151. Furthermore, the illuminative lamp side socket member 152 is pushed upwards. In consequence, the engagement claws 161, 161 formed externally from the storage portion 166 engage with the engagement claws 160, 160 formed externally from the flange 156A of the main body side socket member 151.

In consequence, the illuminative lamp side socket member 152 can stably be attached to the main body side socket member 151. Therefore, as compared with a conventional constitution in which the illuminative lamp is held by clips, the illuminative lamp 14 can easily be attached to the lower surface of the shelf 8, and an attaching operation can be simplified. Since the illuminative lamp side socket member 152 is stably engaged with the main body side socket member 151, the terminals 14A of the illuminative lamp 14 can stably and electrically be connected to the power supply contact pieces 157 stored in the main body side socket member 151 via conducive members such as the power receiving terminals 168 and the power supply terminals 158, and illumination can stably and safely be performed.

Moreover, at this time, the waterproof rubber 163 is disposed in the connecting portion 156 of the main body side socket member 151. Therefore, the waterproof rubber 163 can isolate the power receiving terminals 168 of the illuminative lamp side socket member 152 and the power supply terminals 158 of the main body side socket member 151 from the outside in a watertight manner.

In consequence, especially in a case where the inside of a showroom 5 is cooled at a predetermined temperature as in the present embodiment, since the connecting portion is divided by the waterproof rubber 163, it is possible to inhibit condensation collected on the surface of the socket 150 from being attached to the terminals 158, 168 to cause short-circuit. Therefore, even when the condensation is collected on the illuminative lamp 14 or the socket 150, the illuminative lamp 14 can safely be used.

It is to be noted that to release the engagement between the main body side socket member 151 and the illuminative lamp side socket member 152, the front and rear engagement claws 161, 161 formed at the illuminative lamp side socket member 152 are manually held. The engagement claws 161 are pressed inwards to deform the engagement claws 161 inwards, thereby releasing the engagement between the engagement claws 161 and 160.

What is claimed is:

1. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and a connecting portion, a water proof rubber being disposed between the connecting portion and the internal power supply portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a thermal insulation cylinder surrounding a periphery of the illuminative lamp, a terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member and the illuminative lamp side socket member having engagement portions which are disengageably engaged with each other, each engagement portion having an outwardly extending operating portion, the operating portion being operated to thereby disengageably engage the end portion.

2. The showcase according to claim 1, wherein the engagement portion of the main body side socket member has a terminal holding portion to hold the terminal of the illuminative lamp in a state in which the illuminative lamp side socket member is attached to the main body side socket member.

3. A showcase provided with an illuminative lamp having terminals at end portions, the showcase comprising:

sockets which connect an illuminative lamp to a power source of a main body, each socket including:

a main body side socket member fixed to the main body and having an internal power supply portion and an connecting portion, a water proof rubber being disposed between the connecting portion and the internal power supply portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member and the illuminative lamp side socket member having engagement portions which are disengageably engaged with each other, the engagement portion of the illuminative lamp side socket member being pressed inwards, towards the main body side socket member, to disengage from the engagement portion of the main body side socket member, the main body side socket member being provided with an inclined surface which is formed externally from the engagement portion and which comes away from the engagement portion while inclined so as to form an acute angle with the engagement portion and the main body of the show case, the main body side socket member further including: a finger insertion space constituted between the inclined surface and the engagement portion.

4. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and a connection portion, a water proof rubber being disposed between the connection portion and the internal power supply portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a thermal insulation cylinder surrounding a periphery of the illuminative lamp, a terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member having a capacitor storage section in which a capacitor is stored.

5. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and a connection portion, a water proof rubber being disposed between the connection portion and the internal power supply portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a thermal insulation cylinder surrounding a periphery of the illuminative lamp, a terminal of the illuminative lamp being electrically connected to the power supply portion of the main body side socket member directly or via a conductive member in a state in which the illuminative lamp side socket member mounted on the illuminative lamp is attached to the main body side socket member, the main body side socket member having a fixing section to the main body, the fixing section being provided with a ground terminal fixing portion.

6. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and a connecting portion, a water proof rubber being disposed between the connecting portion and the internal power supply portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a terminal of the illuminative lamp being electrically connected to the power supply portion of the main body side socket member directly or via a conductive member in a state in which the illuminative lamp side socket member mounted on the illuminative lamp is attached to the main body side socket member, the showcase further comprising: a thermal insulation cylinder which surrounds a periphery of the illuminative lamp, the thermal insulation cylinder having an end portion held by a thermal insulation cylinder holding portion formed on an outer peripheral surface of an attachment section of the illuminative lamp side socket member.

7. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and a connecting portion, a water proof rubber being disposed between the connecting portion and the internal power supply portion; and an illuminative lamp side socket member mounted on the illuminative lamp and detachably attached to the main body side socket member so as to cover the connecting portion, a terminal of the illuminative lamp being electrically connected to the power supply portion of the main body side socket member directly or via a conductive member in a state in which the illuminative lamp side socket member mounted on the illuminative lamp is attached to the main body side socket member, the illuminative lamp side socket member having a drain hole where the illuminative lamp side socket member covers the connecting portion via which condensation water which collects in the illuminative lamp side socket member is discharged.

8. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion and connecting portion; and an illuminative lamp side socket member mounted on the illuminative lamp and detachably attached to the main body side socket member so as to cover the connecting portion, the illuminative lamp side socket member having a drain hole where the illuminative lamp side socket member covers the connection portion, a terminal of the illuminative lamp being electrically connected to the power supply portion of the main body side socket member directly or via a conductive member in a state in which the illuminative lamp side socket member mounted on the illuminative lamp is attached to the main body side socket member, the showcase further comprising:

a waterproof mechanism including a water proof rubber disposed between the connecting portion and the internal power supply portion, and a cylinder which surrounds the illuminative lamp to isolate the power supply portion and the terminal of the illuminative lamp from the outside in a watertight manner in a state in which the illuminative lamp side socket member is attached to the main body side socket member.

9. A showcase provided with an illuminative lamp having terminals at end portions, the showcase comprising:

sockets which connect an illuminative lamp to a power source of a main body of the showcase, each socket including:

a main body side socket member fixed to the main body and having an internal power supply portion; and an illuminative lamp side socket member mounted on the illuminative lamp and detachably attached to the main body side socket member, a thermal insulation cylinder surrounding a periphery of the illuminative lamp, the main body side socket member including:

the internal power supply portion and a connecting section provided with an inserting portion capable of passing a terminal of the illuminative lamp, the illuminative lamp side socket member including:

an attachment section which is to be attached to an end portion of the illuminative lamp; and a storage section formed externally from the attachment section so as to cover the connecting section, the illuminative lamp side socket member having a drain hole via which condensation water is discharged, the drain hole being provided where the illuminative lamp side socket member covers the connection section in a state in which the illuminative lamp side socket member is attached to the main body side socket member, the terminal being opposed to an inside of the storage section in a state in which the attachment section is attached to the end portion of the illuminative lamp, the terminal configured to enter the inserting portion and electrically connected to the power supply portion in a state in which the connecting section is stored in the storage section, the storage section of the illuminative lamp side socket member being provided with a pressing portion to urge the power supply portion inward, that is, toward the terminal in a state in which the connecting section is stored in the storage section, wherein a water proof rubber is disposed between the connecting section and the internal power supply portion.

* * * * *